US005818434A

United States Patent [19]

Yamamoto et al.

[11] Patent Number: 5,818,434

[45] Date of Patent: Oct. 6, 1998

[54] METHOD AND APPARATUS FOR CONTROLLING IMAGE DISPLAY

[75] Inventors: Mitsuru Yamamoto, Yokohama; Takayuki Kikuchi, Tokyo, both of Japan

[73] Assignee: Canon Kabushiki Kaisha, Tokyo, Japan

[21] Appl. No.: 725,513

[22] Filed: Oct. 4, 1996

Related U.S. Application Data

[62] Division of Ser. No. 834,651, Feb. 12, 1992, Pat. No. 5,745,101.

[30] Foreign Application Priority Data

| | | | |
|---|---|---|---|
| Feb. 14, 1991 | [JP] | Japan | 3-020667 |
| Feb. 14, 1991 | [JP] | Japan | 3-020668 |
| Feb. 14, 1991 | [JP] | Japan | 3-020669 |

[51] Int. Cl.[6] ..... G09G 1/00

[52] U.S. Cl. ..... 345/203; 345/508; 345/511

[58] Field of Search ..... 345/507, 508, 345/511, 516, 203

[56] References Cited

U.S. PATENT DOCUMENTS

| | | | |
|---|---|---|---|
| 4,598,384 | 7/1986 | Shaw et al. | 345/116 |
| 4,779,223 | 10/1988 | Asai et al. | 340/789 |
| 4,788,540 | 11/1988 | Tokumitsu et al. | 340/732 |
| 4,803,475 | 2/1989 | Matsueda | 340/799 |
| 4,920,337 | 4/1990 | Kue | 340/721 |
| 5,025,396 | 6/1991 | Parks et al. | 345/116 |
| 5,132,809 | 7/1992 | Kikuchi et al. | 358/403 |
| 5,138,307 | 8/1992 | Tatsumi | 345/115 |

FOREIGN PATENT DOCUMENTS

| | | |
|---|---|---|
| 2559933 | 8/1985 | France . |
| 3631329 | 3/1988 | Germany . |

*Primary Examiner*—Amare Mengistu

*Attorney, Agent, or Firm*—Fitzpatrick, Cella, Harper & Scinto

[57] ABSTRACT

Method and apparatus of controlling an image display process in which image data is input to display an image of the image data on a display. The input image data is stored in a first memory with respect to pixels, and a second memory, having at least an address space corresponding to a display region on the display in which the image of the image data is displayed, stores, in each display address, address information on an address of the first memory in which pixel data in the image data on a pixel to be displayed in the display region in accordance with the display address. The address information on the address in which the pixel data is stored is read out and the pixel data is read out from the first memory based on the address information to display the pixel.

15 Claims, 24 Drawing Sheets

| ADDRESS | CONTENT |
|---|---|
| 0 | DATA ON PIXEL P |
| ⋮ | |
| Xs (ys - 1) + xs - 1 | |
| ⋮ | |
| Xs • Ys - 1 | |

108

| ADDRESS | CONTENT | FLAG |
|---|---|---|
| 0 | | |
| ⋮ | | |
| Xd (yd - 1) + xd - 1 | Xs (ys - 1) + xs - 1 | IMAGE DATA |
| ⋮ | | |
| Xd · Yd - 1 | | |

112

| ADDRESS | CONTENT |
| --- | --- |
| 0 | |
| ⋮ | |
| Xd (yd - 1) + xd - 1 | Xs (ys - 1) + xs - 1 |
| ⋮ | |
| Xd · Yd - 1 | |

212

FIG. 19

IMAGE MEMORY

| ADDRESS | CONTENT |
|---|---|
| Aof | |
| ⋮ | |
| Aof + AXs (ays - 1) + axs - 1 | DATA ON PIXEL PA |
| ⋮ | |
| Bof | |
| ⋮ | |
| Bof + BXs (bys - 1) + bxs - 1 | DATA ON PIXEL PB |
| ⋮ | |
| Cof | |
| ⋮ | |
| Cof + CXs (cys - 1) + cxs - 1 | DATA ON PIXEL PC |
| ⋮ | |
| Dof | |
| ⋮ | |
| Dof + DXs (dys - 1) + dxs - 1 | DATA ON PIXEL PD |

FIG. 25

DISPLAY MEMORY

| ADDRESS | CONTENT |
|---|---|
| 0 | |
| ⋮ | |
| Xd • (ayd - 1) + axd - 1 | Aof + AXs (ays - 1) + axs - 1 |
| ⋮ | |
| Xd • (byd - 1) + bxd - 1 | Bof + BXs (bys - 1) + bxs - 1 |
| ⋮ | |
| Xd • (cyd - 1) + cxd - 1 | Cof + CXs (cys - 1) + cxs - 1 |
| ⋮ | |
| Xd • (dyd - 1 ) + dxd - 1 | Dof + DXs (dys - 1) + dxs - 1 |
| ⋮ | |
| Xd • Yd - 1 | |

FIG. 27

METHOD AND APPARATUS FOR CONTROLLING IMAGE DISPLAY

This application is a division of application No. 07/834,651, filed Feb. 12, 1992, now U.S. Pat. No. 5,745,101.

BACKGROUND OF THE INVENTION

1. Field of the Invention

This invention relates to a method and apparatus for controlling image display and, more particularly, to a method and apparatus for controlling display of images formed on a screen from a plurality of series of image information items supplied.

2. Description of the Related Art

A conventional display controller of this kind is constructed as shown in FIG. 4. Information 21 on an image output from an image file or the like is input through an interface 22, e.g., RS232C, RS422, GPIB or SCSI, and is stored in a buffer memory 23. The image data stored in the buffer memory 23 is temporarily stored in an internal register of a CPU 24 and is thereafter written in a display memory 25. The coordinates of pixels displayed on a screen of a display unit 26 correspond to pixel address values stored in the display memory 25 in a one-to-one relationship. Each pixel based on the image signal 21 can be formed at any position on the screen of the display 26 by selecting the address of the display memory 25 in which the corresponding image data item is written. The CPU 24 therefore calculates the write address of each image pixel in the display memory 25 based on the position at which the pixel is to be displayed on the screen of the display 26, and writes the data on a corresponding image pixel into the calculated write address.

The CPU 24 can also write data on characters, figures and the like in the display memory 25 as well as image signal 21. It is thereby possible to combine image information and drawing information such as information on characters, figures or the like on the display memory 25. Image information thereby combined is read under the control of a read control circuit 27 to be displayed on the display 26.

FIG. 5 is a block diagram of the construction of another conventional image display controller. A video signal 31 output from a video camera or a VTR is input to a sync separation unit 32 to be separated into a clock signal, a horizontal sync signal and an image signal. A horizontal writing counter 33 and a vertical writing counter 34 generate addresses for writing image data output from the sync separation circuit 32 in an image memory 35. The horizontal writing counter 33 is preset to a predetermined value by the horizontal sync signal, and counts the clock signal to output horizontal-direction addresses. The vertical writing counter 34 is preset to a predetermined value by a vertical sync signal, and counts the horizontal sync signal to output vertical-direction addresses. The image signal is converted into a digital signal by an A/D converter 36 and is thereafter written in addresses of the image memory 35 designated by the horizontal writing counter 33 and the vertical writing counter 34 in synchronization with the clock signal.

Drawing data on characters, figures and the like to be displayed by a display unit 41 is written in a display memory 38 under the control of a CPU 37. The image data written in the image memory 35 and the drawing data written in the display memory 38 are read from addresses of the display memory 38 designated by outputs from a vertical reading counter 39 and a horizontal reading counter 42 and are combined by a composing unit 40 to display the image on the screen of the display unit 41.

The above-described conventional display controllers entail drawbacks described below.

That is, in the first example of the conventional display controller, image data stored in the buffer memory 23 through the interface 22 is transferred to predetermined addresses in the display memory 25 by the CPU 24. The overhead time for fetching instructions, decoding instructions and other operations in the CPU 24 required for this data transfer is substantially long. The processing for transferring data from the buffer memory 23 to the display memory 25 is therefore delayed, so that data on all pixels in each frame of an image cannot be transferred to the display memory 25 within one frame period of the same image. It is therefore impossible to display animation images, for example.

In the second example, addresses of the image memory 35 in which each pixel data in image information is written are generated by the horizontal writing counter 33 and the vertical writing counter 34, and these addresses therefore depend upon the number of places of the counters 33 and 34. Accordingly, an image having a number of pixels in the horizontal or vertical direction greater than the number of places of the horizontal writing counter 33 or the vertical writing counter 34 cannot be written in the image memory 35.

In general, the number of pixels in the horizontal and vertical directions of a still image obtained with a scanner or the like are greater than those of an animation image obtained with a VTR or the like. It is therefore possible that an image display apparatus arranged for VTR in accordance with the second example cannot display a still image input through a scanner.

FIG. 6 shows an example of a process of changing an image information display position on the display screen of the display apparatus shown in FIG. 5. In this example, the positions of two images 402 and 403 displayed on the screen are changed. In FIG. 6, the state before the displayed positions are changed is indicated by 400, and the state after the displayed positions of the images have been changed is indicated by 401. Sections 410 and 412 represent drawing information (characters) stored in display memory 38, and a section 411 represents image information stored in image memory 35. The displayed position of a composite image 402 based on the image information and the drawing information and the displayed position of an image 403 based on the drawing information alone are changed by the conventional apparatus shown in FIG. 5 in the following manner.

(1) Values preset in vertical writing counter 34 and/or horizontal writing counter 33 are changed into selected values to change the position in which each image is formed on display 41.

(2) Drawing information 410 and drawing information 412 written in display memory 38 are rewritten therein to display the image in the desired positions on display 41.

(3) Because calculation information for combining image information 411 and drawing information 410 is stored in addresses of a display control memory (not shown) determined in correspondence with the displayed positions on the screen of the display 41, it is necessary to rewrite the calculation information in predetermined addresses of the display control memory with movements of image information 411 and drawing information 410 such as those shown in FIG. 6.

Thus, with respect to execution of these three operations for moving a composite image such as that shown in FIG. 6 in the above-described conventional arrangements, the following problems are encountered.

[1] The movement of the composite image is delayed since rewriting of drawing information in display memory 38 and rewriting of calculation information in the display control memory are required.

[2] Because the three operations for the movement of image information 411, the movements of drawing information 410 and 412 and the movement of the calculation information in the display control memory are successively performed, intermediate effects of these operations are successively displayed on the screen of the display 41. In particular, during the movement of the calculation information in the display control memory, it is possible that an unexpected display, e.g., a display of image information originally hidden, occurs if processing for displaying images of drawing information 410 and 412 with priority is designated.

An image display system has also been developed which is used to monitor a plurality of series of image information transmitted through a transmission path to enable process observation in a factory or a meeting which is held in an office building by attendance through monitor displays. FIG. 7 shows an example of such a system using an image signal formed of multiplexed image series A to D output from a plurality of image information sources such as TV cameras 501 to 503 and a VTR 504 in a time series. An image display controller for processing such an image signal is arranged as shown in FIG. 8.

Through a line 81 shown in FIG. 8, four image series A, B, C, and D are transmitted in a time series. An interface unit 82 controls interfacing with the transmission path 81. The interface 82 has a function of extracting an image series discrimination number added to the top of each series of image data items as well as a function of separating image data portions, a clock signal and horizontal and vertical sync signals required for writing image data in an image memory 85. A horizontal writing counter 83 and a vertical writing counter 84 generate addresses in an image memory 85 for writing image data. The horizontal writing counter 83 is preset to a value output from the interface 82 by the horizontal sync signal, and counts the clock signal to output horizontal-direction addresses of the image memory 85. Similarly, the vertical writing counter 84 is preset to a value output from the interface 82 when writing one-frame image data of each image series is started, and counts the horizontal sync signal output from the interface 82 to output vertical-direction addresses of the image memory 85.

The interface 82 outputs preset values of the horizontal writing counter 83 and the vertical writing counter 84 corresponding to the image display position of each image series from extracted image series identification numbers to the horizontal writing counter 83 and the vertical writing counter 84. In this conventional image display controller, the horizontal writing counter 83 is preset to "0" with respect to image information of the series A and C, and is preset to ½ of the number of horizontal pixels of a display unit 86 with respect to the series B and D. Also, the preset value of the vertical writing counter 84 is preset to "0" with respect to image information of the series A and B, and is ½ of the number of vertical pixels of the display unit 86 with respect to the series C and D. Four series of images are thereby displayed on the screen of the display 86, as shown in FIG. 8. The image memory 85 is a dual port memory which can be operated for writing and reading independently. A horizontal reading counter 87 and a vertical reading counter 88 count a timing signal output from a read control unit 89 to generate read addresses of the image memory 85. The display 86, e.g., a CRT, displays images based on image data read from the image memory 58 in synchronization with the timing signal from the read control unit 89.

In the controller thus arranged, one image series of an image signal input from the transmission path 81 is discriminated by the interface 82, and the clock signal and the horizontal sync signal are extracted from the input signal by the interface 82. The image data is thereafter input to and stored in the image memory 85. At this time, after the interface 82 has discriminated the image series, it presets desired values in the horizontal writing counter 83 and the vertical writing counter 84. The image signal input into the image memory 85 is thereby written in synchronization with the clock signal in an address of the image memory 85 addressed by address values output from the horizontal writing counter 83 and the vertical writing counter 84. When one-pixel data is written in this manner, the horizontal writing counter 83 is incremented by the clock signal. After writing on one horizontal scanning line has been completed, the horizontal writing counter 83 is preset to the predetermined value again, while the vertical writing counter 84 is incremented by the horizontal sync signal which indicates the completion of writing on one horizontal scanning line. After one frame of one-series animation image has been written in this manner, data on a frame of a next-series animation image is input and written in the image memory 85 in the same manner.

When the image data items written in the image memory 85 are used to display the image, they are successively read out in synchronization with the display timing of the display 86 by address values output from the vertical reading counter 88 and the horizontal reading counter 87 to form the image on the display 86.

The above-described conventional display controller, however, entails a drawback in that if image display regions on the display 86 are moved so that the display regions for images in two different series overlap each other, image data items on the different-series images are alternately overwritten in the image memory 85, so that both the images in the overlap region are not normally displayed.

That is, if the image of an image series A is displayed by lowering the displayed position as shown in FIG. 9, the image series A is displayed at times $t_1$, $t_2$, $t_5$, $t_6$, . . . in an overlap region 95 while an image series C is displayed at times $t_3$, $t_4$, $t_7$, . . . in the overlap region 95, as shown in FIG. 10; the image series A and C are alternately displayed in the overlap region 95, resulting in failure to obtain a normal display.

Further, in a case where images in five series, i.e., image series A, B, C, D and E are successively transmitted on the transmission path 81 as shown in FIG. 12, and where the image series A, B, C, and D are allocated in the vertical and horizontal directions on the screen of the display 86 and the image series E is allocated at the center as shown in FIG. 11, images of the animation image series E and the other image series overlapping each other are alternately displayed in central overlap regions 91 to 94 as shown in FIG. 11, so that the image of animation image series E cannot be normally displayed. Thus, there is a possibility that the above-described conventional display controller fails to display an image of an image series transmitted on the transmission path in a desired position.

SUMMARY OF THE INVENTION

In view of the above-described circumstances, an object of the present invention is to provide an image display control method/apparatus capable of easily changing addresses from which image data stored in a memory is read out to display images based on the image data.

Another object of the present invention is to provide an image display control method/apparatus in which display addresses on the screen and addresses of image information stored in a memory are stored while being correlated with each other so that displayed images can be changed only by changing the stored addresses.

Still another object of the present invention is to provide an image display control method/apparatus in which a plurality of groups of image information stored in a plurality of memories can be combined and displayed in a desired position on the display screen only by changing the addresses from which the image information is read out.

A further object of the present invention is to provide an image display control method/apparatus in which a plurality of groups of image information stored in a plurality of memories are combined in accordance with composite information, and displayed in a desired position on the display screen by changing the read addresses of the image information in a simple manner, and in which reading of the composite information can be changed in correspondence with reading of the image information.

A still further object of the present invention is to provide an image display method/apparatus in which a desired number of series of images among a plurality of series of images input with respect to time can be displayed in an arbitrary position on the screen.

To achieve these objects, according to one aspect of the present invention, there is provided a method of controlling an image display process in which image data is input to display an image of the image data on a display, the method comprising the steps of storing the input image data in a first memory with respect to pixels, storing, in each of display addresses of a second memory having at least an address space corresponding to a display region on the display in which the image of the image data is displayed, address information on an address of the first memory in which pixel data in the image data on a pixel to be displayed in the display region in accordance with the display address is stored, and reading out the address information on the address in which the pixel data is stored, and reading out the pixel data from the first memory based on the address information to display the pixel.

According to another aspect of the present invention, there is provided an image display control apparatus for inputting a plurality of groups of image data and displaying images of the image data on a display, the controller comprising first memory means storing the first group of image data with respect to pixels, second memory means having at least a display address space corresponding to a display region on the display in which the image of the first group of image data is displayed, the second memory means storing, along with discrimination information, address information on an address in which pixel data of the first group of data is stored, while correlating the address information with the address with which the corresponding pixel is displayed, the second memory means storing the second group of image data, and display means for reading out the address information on the address in which the pixel data is stored, reading out the pixel data from the first memory based on the address information to display the pixel when the first group of image data is designated by the discrimination information, and reading out the second group of image data from the second memory when the first group of image data is not designated.

According to still another aspect of the present invention, there is provided an image display control apparatus comprising discrimination means for discriminating a plurality of series of image data items input with respect to time, image memory means for storing each of the plurality of series of image data items, address generation means for generating addresses with which image data is written in the image memory means while preventing overlapping between the series of image data items, address memory means for storing the address values of the image memory means with which the image data is stored while correlating the address values with the positions in which the series of image data items are respectively displayed, and display means for reading out each series of image data from the image memory means based on the address values stored in the address storage means.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 19 is a diagram of a state in which pixel P of image information shown in FIG. 15 is stored in a display memory in accordance with the third embodiment;

FIG. 25 is a diagram of the data construction of the image memory in which pixel data of each image series is stored in accordance with the fifth embodiment;

FIG. 27 is a diagram of the data construction of the display memory in which data on pixels displayed on the display screen is stored in accordance with thefifth embodiment;

DESCRIPTION OF THE PREFERRED EMBODIMENTS

Preferred embodiments of the present invention will be described below with reference to the accompanying drawings.

Figure 1:
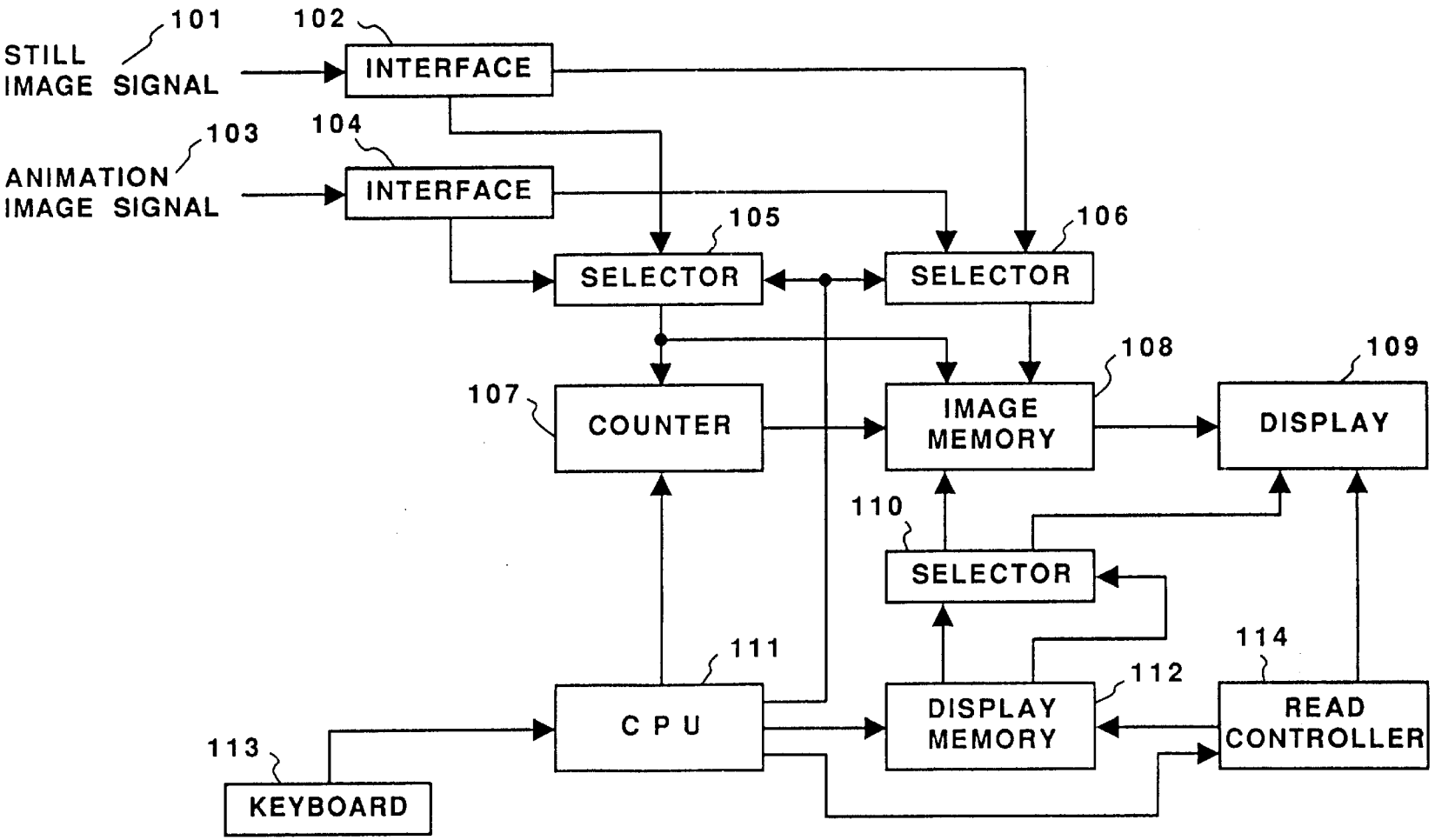
FIG. 1 is a block diagram schematically showing the construction of an image display apparatus in accordance with a first embodiment of the present invention.

FIG. 1 is a block diagram schematically showing the construction of an image display apparatus in accordance with the first embodiment of the present invention. A still image signal 101 is input from a scanner or the like to an interface 102 such as RS232C, RS422, or SCSI. The interface 102 has a function of extracting a clock signal corresponding to unit pixels from the input still image signal 101 and a function of converting the still image signal 101 into parallel signals with respect to pixels if the still image signal 101 is input serially. An animation image is input from a VTR or the like to an interface 104 such as RS232C, RS422, or SCSI. The interface 104 has a function of extracting a desired clock signal from the animation image signal 103 and a function of sampling and quantizing the animation image based on this clock signal.

A selector 105 selects one of the clock signals output from the interfaces 102 and 104 by a control signal from a CPU 111 to output the selected clock signal to a counter 107. Similarly, a selector 106 selects one of the image signals output from the interfaces 102 and 104 by a control signal from the CPU 111 to output the selected image signal to an image memory 108. The counter 107 counts the clock signal output from the interface 102, i.e., the number of pixels written in the image memory 108 and thereby updates the write address of the image memory 108 for the next pixel data writing by outputting a corresponding value. The image memory 108 stores image information supplied via the interface 102 and 104. A display unit 109 displays images based on information stored in a display memory 112.

The CPU 111 controls writing of still image signal 101 and animation image signal 103 in the image memory 108 in accordance with an instruction input through a keyboard 113. Also, the CPU 111 calculates address values of pixels in the image memory 108 which pixels are represented by image information written in the image memory 108, and writes these address values in addresses of the display memory 112 corresponding to coordinates with which the pixels are to be displayed on the display 109.

Further, the CPU 111 writes drawing information such as information on characters, figures or the like in the display memory 112. In the display memory 112, display information items representing pixels to be displayed on the display 109 are stored with respect to unit words while being correlated with the pixels. Information items stored in each word include a flag indicating whether the stored information is image information or drawing information. A selector 110 changes the destination to which an output signal from the display memory 112 is transmitted between the image memory 108 and the display 109 in accordance with this flag. Through the keyboard 113, an instruction for selecting image information to be input, display coordinates on the display 109, the number of pixels in the horizontal or vertical direction of input image information, and so on can be input. A read controller 114 outputs various sync signals to the display 109 and reads out information stored in the display memory 112 in synchronization with each sync signal to display corresponding images on the display 109.

Figures 13, 14:
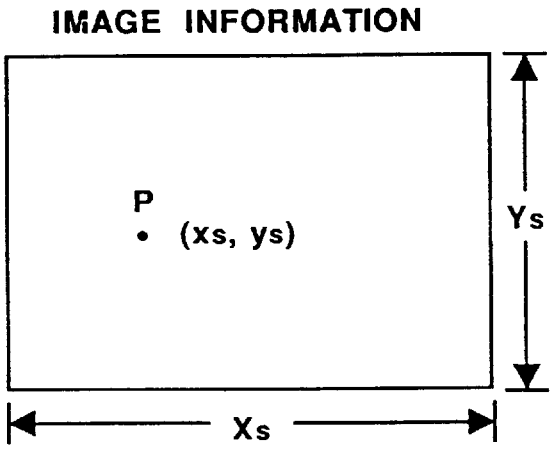
FIG. 13 is a diagram of an image area for image information input to an image display apparatus in accordance with the first embodiment of the present invention.
FIG. 14 is a diagram of a state in which pixel P of image information input to the image display apparatus in accordance with the first embodiment is stored in an image memory.
Figures 15, 16:
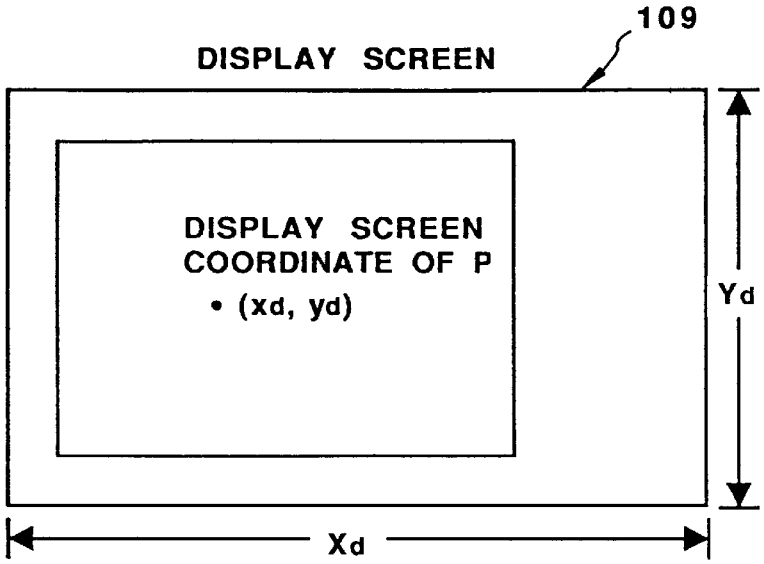
FIG. 15 is a diagram of an area of a display screen in which image information is displayed in accordance with the embodiments.
FIG. 16 is a diagram of a state in which pixel P of image information shown in FIG. 15 is stored in a display memory in accordance with the first embodiment.
Figure 17:
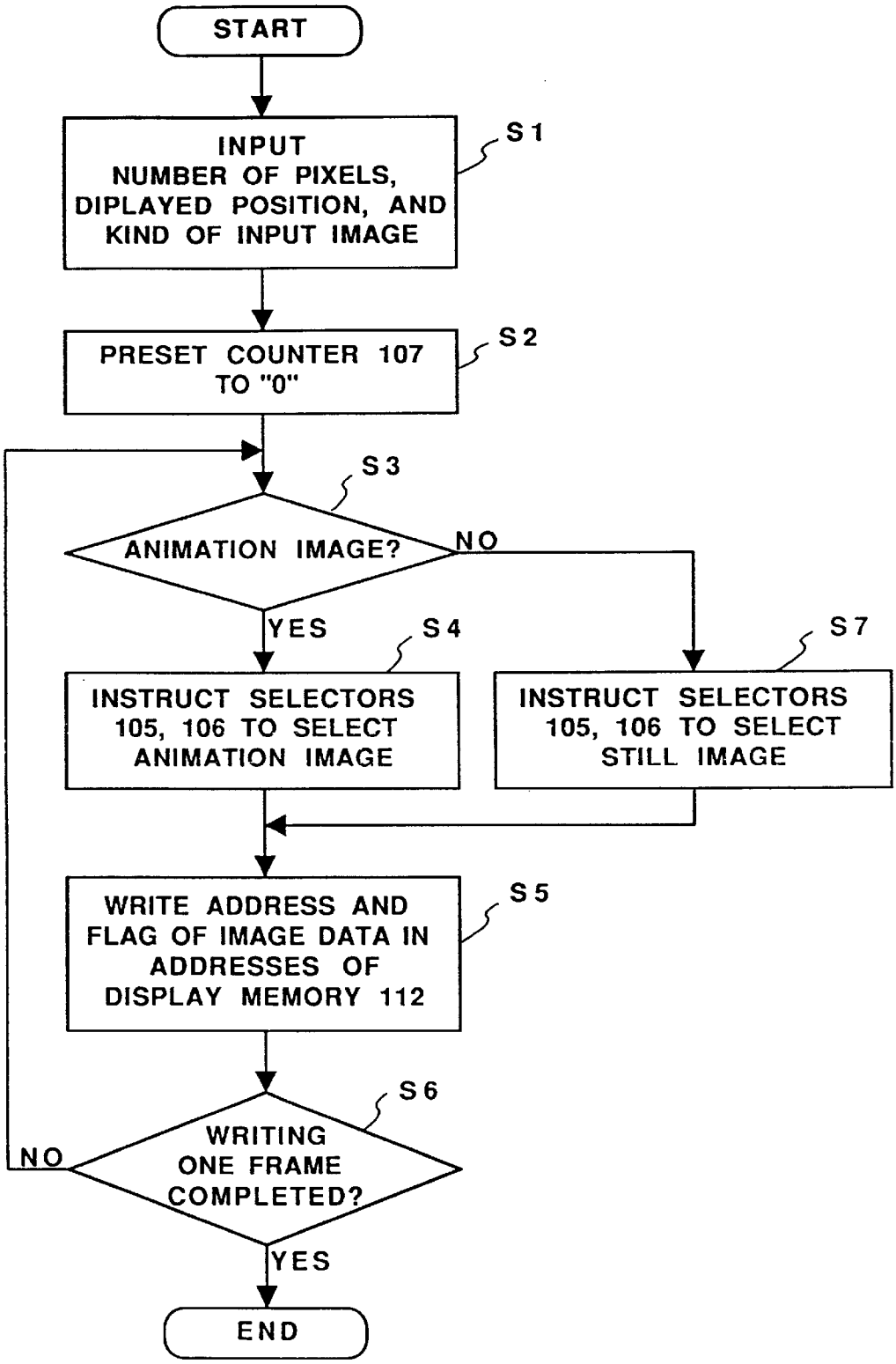
FIG. 17 is a flowchart of a control process conducted by the CPU of the first embodiment.

For the following description, it is assumed here that, as shown in FIG. 13, the number of pixels in the horizontal direction of input image information is $X_s$, the number of pixels in the vertical direction is $Y_s$, and the coordinate of an arbitrary pixel P of an input image is $(x_s, y_s)$. It is also assumed that, as shown in FIG. 15, the number of pixels in the horizontal direction which can be displayed on the display 109 is $X_d$, the number of pixels in the vertical direction is $Y_d$, and the coordinate on the display 109 with which the pixel P is to be displayed is $(x_d, y_d)$. The operation of the first embodiment will now be described below with reference to FIG. 1 and the flowchart of FIG. 17.

In step S1, input information indicating the numbers of pixels in both the horizontal and vertical directions and the displayed position on the display 109, and information for discriminating whether the input image information is provided as a still image signal 101 or an animation image signal 103 are input through the keyboard 113. In step S2, the counter 107 is preset to "0". If it is determined in step S3 that the input information is an animation image signal 103, the process proceeds to step S4 to control the selectors 105 and 106 to output signals from the interface 104 through these selectors. Animation image signal 103 is separated into a clock signal, a vertical sync signal and image signal by the interface 104, and the clock signal separated is input to the counter 107 via the selector 105. The image signal separated from animation image signal 103 is written in a writing address of the image memory 108 in accordance with the output from the counter 107 via the selector 106 in synchronization with the same clock signal.

After writing of one-pixel data in the image memory 108 has been completed, the counter 107 is incremented by the clock signal from the interface 104. Data on one frame of animation image signal 103 is successively written in the image memory from the address "0" to the address ($X_s \cdot Y_s - 1$).

In step S5 of this process, the CPU 111 writes the value of the address of the image memory 108 in which pixel data on each pixel to be displayed is stored in the word in the display memory 112 corresponding to the coordinates with which the corresponding image is to be displayed on the display 109. For example, the address of the image memory 108 in which the data on the above-mentioned pixel ($x_s$, $y_s$) is stored is $\{X_s \cdot (y_s-1)+x_s-1\}$, and the address on the display memory 112 corresponding to the coordinate ($x_d$, $y_d$) on the display 109 with which the pixel P is to be displayed is $\{X_d(y_d-1)+x_d-1\}$ (see FIG. 16). At this time, drawing information such as information on characters, figures or the like is also written in the display memory 112, as mentioned above. Writing characters or figures in the display memory 112 may be performed after writing of one frame in step S6 has been completed or before the step S1. After writing of one-frame in step S6 has been completed, the counter 107 is preset to "0" again by the vertical sync signal output from the interface 104, and the next frame of animation image signal 103 is overwritten in the image memory 108.

FIG. 13 shows an image area for input image information which area is defined by $X_s$ and $Y_s$, and shows coordinate values ($x_s$, $y_s$) of pixel P. FIG. 14 shows the content of the image memory 108 storing this image information. The image information shown in FIG. 13 is stored from the address "0" of the image memory 108, and the pixel data corresponding to pixel P is stored in the address $\{X_s \cdot (y_s-1)+x_s-1\}$ of the image memory 108.

FIG. 15 shows a state in which the image based on this image information is formed on the screen of the display 109, and in which the pixel P is displayed with the coordinate ($x_d$, $y_d$) on the display 109. FIG. 16 shows the corresponding content of the display memory 112. The address $\{X_s(y_s-1)+x_s-1\}$ of the image memory 108 in which the corresponding pixel P is stored is written in the word having the address $\{X_d \cdot (y_d-1)+x_d-1\}$ of the display memory 112. Simultaneously, flag information indicating that the stored information is image information is set in a flag region of the same address of the display memory 112. This data writing is controlled by the CPU 111.

Next, when an instruction is input through the keyboard 113 to input still image signal 101, the process proceeds from step S3 to S7, and the CPU 111 makes the selectors 105 and 106 select and output inputs from the interface 102. Still image signal 101 is thereby converted into parallel signals by the interface 102 and clock signal is extracted with respect to pixels. Thereafter, image information is written in the image memory 108 in the same manner as the animation image signal 103 described above. When writing of all pixels of the input still image signal 101 is completed, the writing in the image memory 108 is completed. During this operation, the CPU 111 conducts inputting coordinates for a desired display on the screen of the display 109 and writing desired data in the display memory 112 according to the numbers of pixels in the horizontal and vertical directions of input still image 101, as in the case of animation image signal 103.

The operation of displaying the content of the image memory 108 based on the data written in the display memory 112 in this manner will now be described below.

When the CPU 111 issues an instruction to display an image, various sync signals are output from the read controller 114 to the display 109, and the data in the display memory 112 is successively read out with respect to unit words in synchronization with each sync signal. Flag information for each word read out is used to change over the selector 110. That is, if the flag is set in drawing information, the selector 110 supplies the output from the display memory 112 to the display 109. The drawing information thereby output to the display 109 is displayed on the screen of the display 109. If the flag information read output from the display memory 112 is set to image information, the selector 110 outputs address information read out from the display memory 112 to the address line of the image memory 108. At this time, the address information output to the address line of the image memory 108 corresponds to the content of the address of the display memory 112 corresponding to each coordinate displayed on the display 109, i.e, the address of the image memory 108 in which the corresponding image data is stored, as shown in FIG. 16. The data on the pixel to be displayed on the display 109 is therefore read from the image memory 108 and is output to the display 109 to display the image.

In this manner, image information written as animation image signal 103 in the image memory 108 is rewritten at a high speed with respect to frames. There is no need to change the content of the display memory 112 as long as the position at which the image of the animation image signal is displayed on the display 109 is not changed. Also, it is possible to display the image of the animation image signal 103 at a desired displayed position on the display 109 only by changing the content of the display memory 112.

Accordingly, to display the animation image, the preset value of the counter 107 is changed with respect to each frame to successively write the animation image information in the image memory 108, and the content of the address (address of image memory 108) corresponding to the display address of each pixel of the image information, which content is stored in the display memory 112, may only be updated to enable the animation images of this image information to be changed over and successively displayed with respect to frames.

In the case of a still image as well, the CPU 111 conducts inputting coordinates for a desired display on the screen of the display 109 and writing desired data in the display memory 112 according to the numbers of pixels in the horizontal and vertical directions of input still image 101, as in the case of animation image signal 103. Still image information 101 written in the image memory 108 in this manner is successively read out by the signal from the read controller 114 to be displayed on the display 109, as in the case of animation image signal 103.

[THE SECOND EMBODIMENT]

Figure 2:
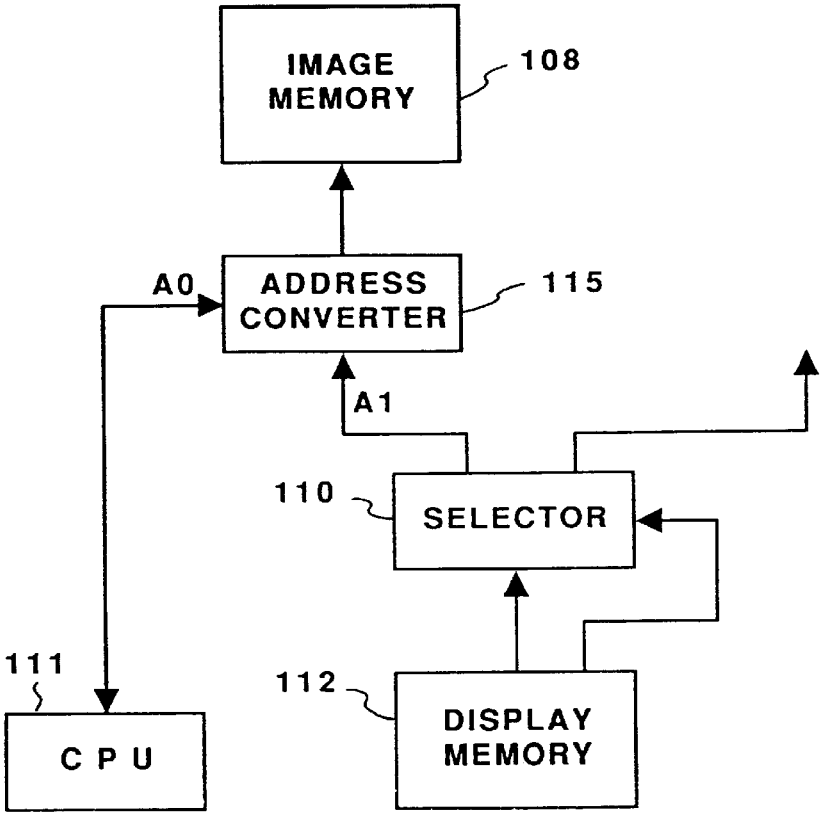
FIG. 2 is a block diagram schematically showing the construction of an image display apparatus in accordance with a second embodiment of the present invention in which an address converter is added to the apparatus of the first embodiment shown in FIG. 1.

FIG. 2 is a block diagram schematically showing the construction of an image display apparatus in accordance with the second embodiment of the present invention. In this embodiment, an address converter 115 for processing address values output from the selector 110 to the image memory 108 is added to the arrangement of the first embodiment. The other components not illustrated in FIG. 2 are identical to those of the first embodiment.

Figure 3:
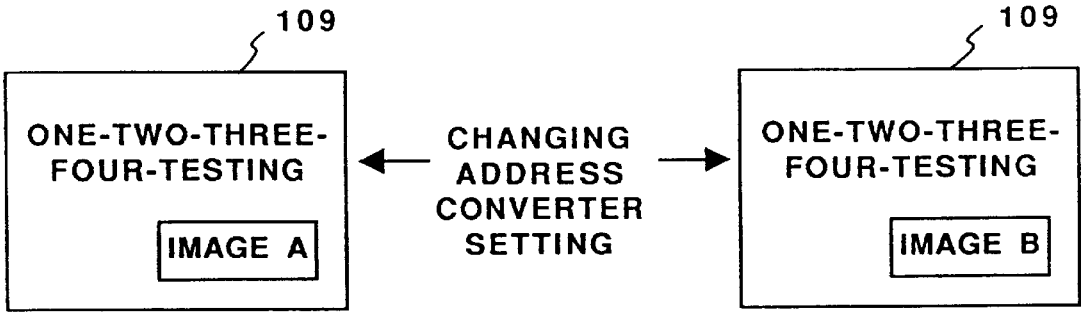
FIG. 3 is a diagram of an example of a process of changing the displayed frame by using the address converter of the second embodiment.
Figure 4:
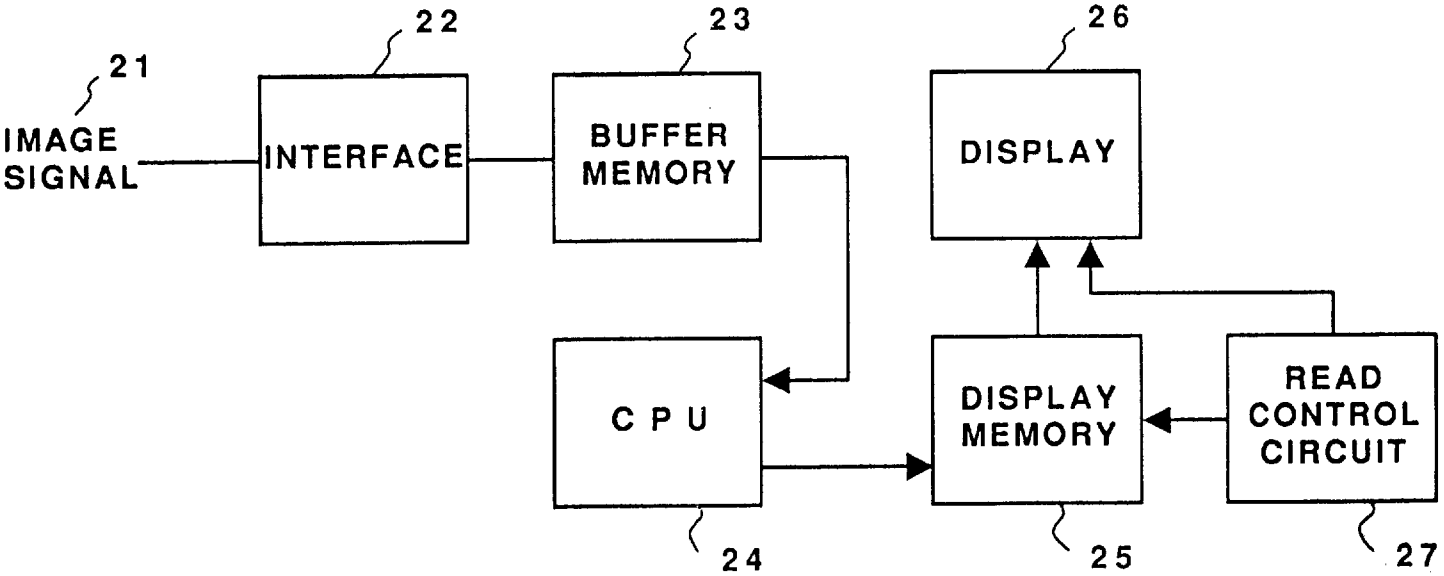
FIG. 4 (PRIOR ART)
FIG. 4 is a block diagram schematically showing a conventional image display apparatus.
Figure 5:
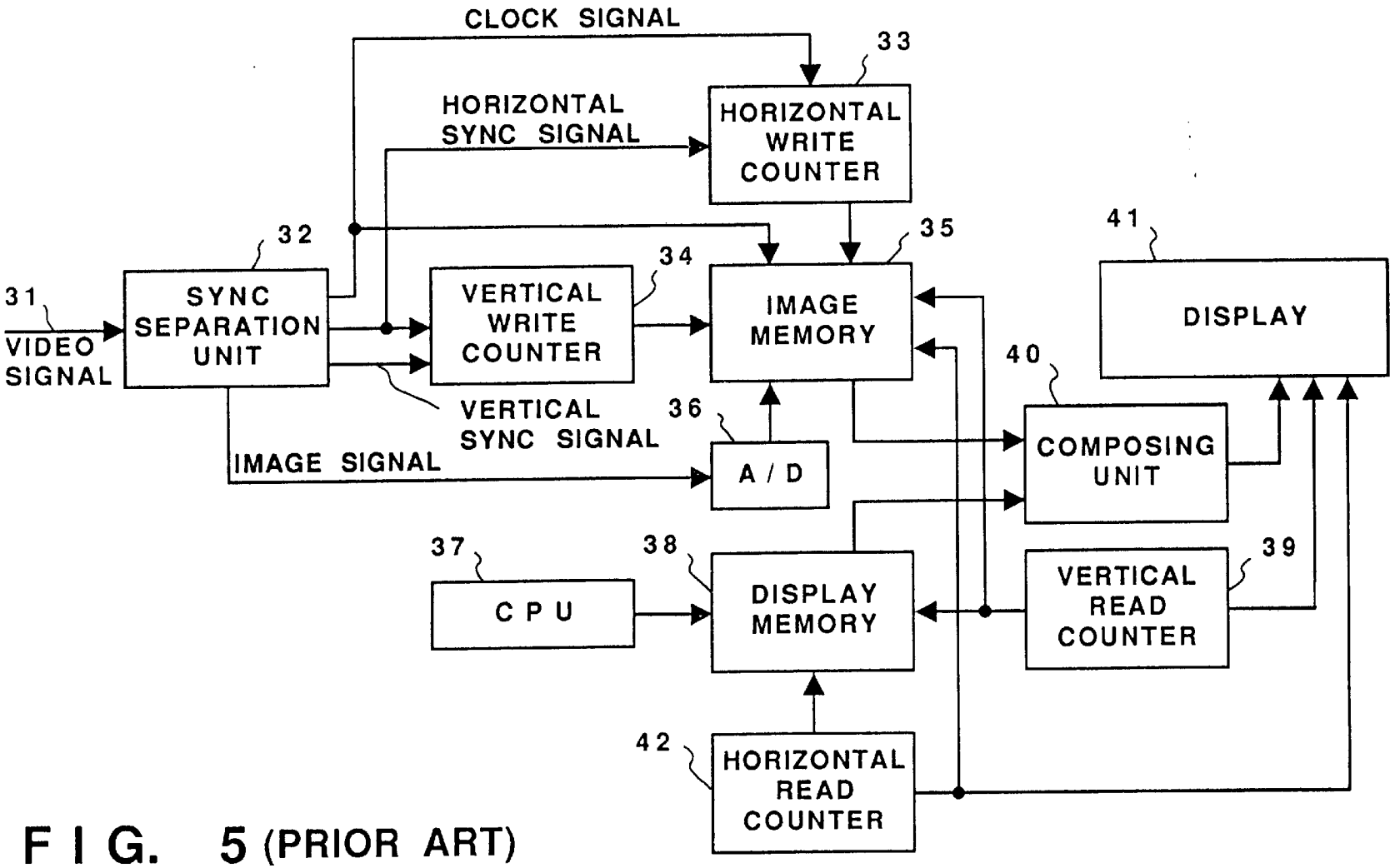
FIG. 5 (PRIOR ART)
FIG. 5 is a block diagram schematically showing another conventional image display apparatus.
Figure 6:
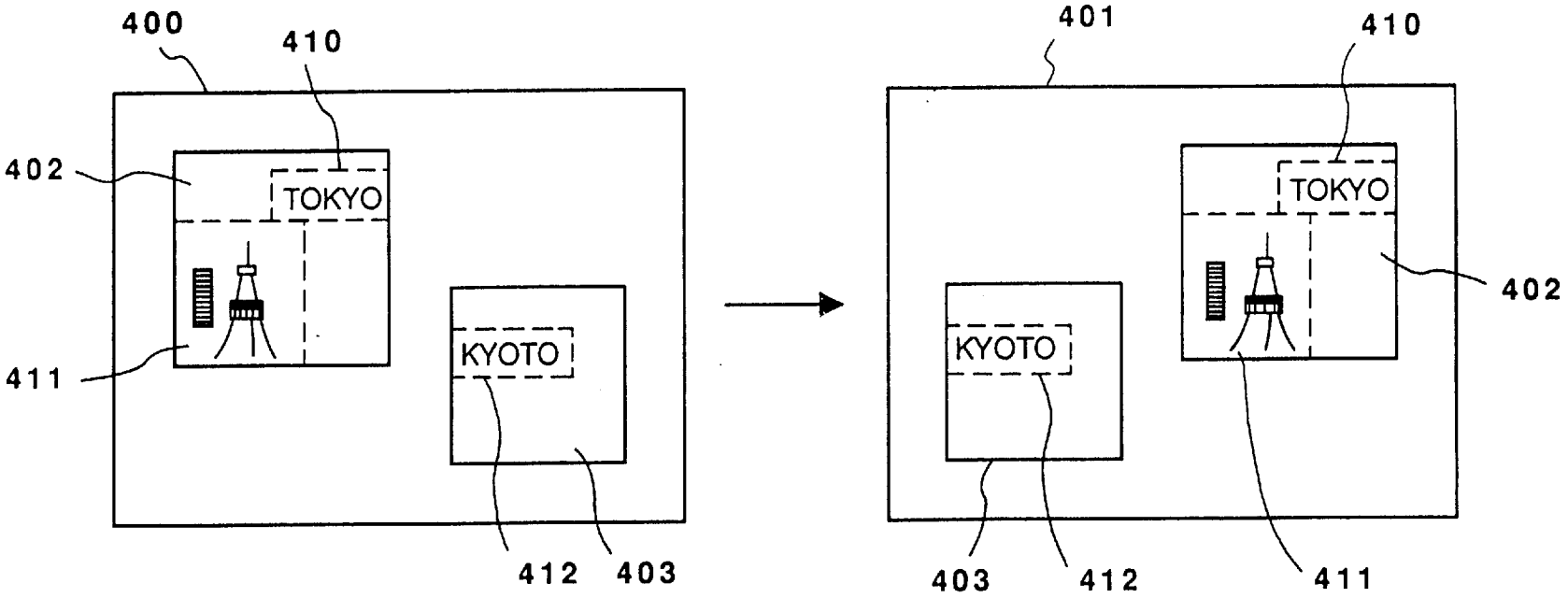
FIG. 6 (PRIOR ART)
FIG. 6 is a diagram of problems of a conventional image display controller relating to displaying a composite image.
Figure 7:
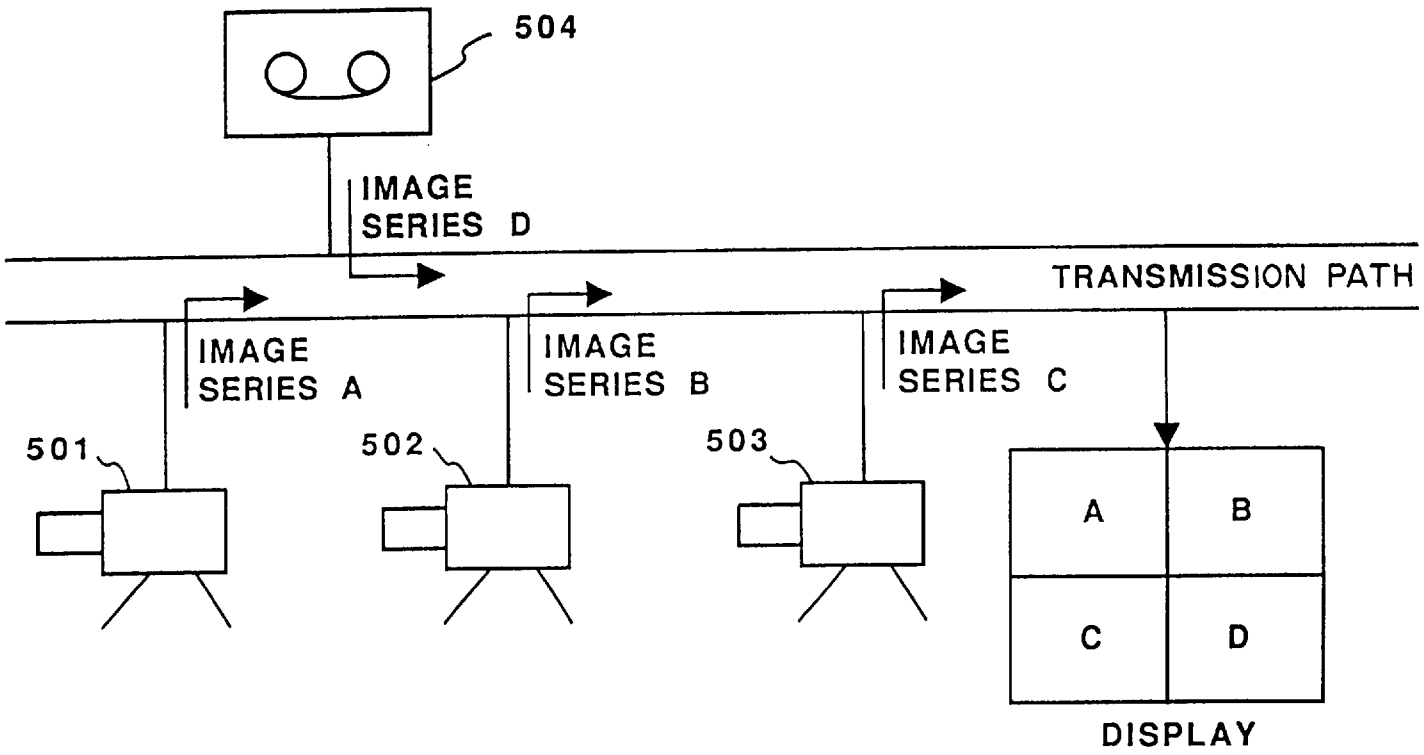
FIG. 7 PRIOR ART
FIG. 7 is a diagram showing use of an ordinary multiplexed image signal.

FIG. 3 is a diagram of an example of a display process in which information on images to be displayed on the display 109 are changed over between image information A and image information B. A process for controlling this image display will be described below.

The address converter 115 adds an added address AO supplied from the CPU 111 to an address value A1 output from the selector 110, and outputs an address obtained by this addition as an address of the image memory 108. Referring to FIG. 2, if image information A is written from address value 0 of the image memory 108 as described above, the CPU 111 sets the added address supplied to the address converter 115 to "0", and writes, in the address of the display memory 112 corresponding to the coordinate of image information A on the screen of the display 109, the address value of each pixel of image information A in the image memory 108, as in the case of the first embodiment.

Next, image information B equal to image information A in both the numbers of pixels in the horizontal and vertical directions is written from address "Q0" of the image memory 108. The value "Q0" is set to a value equal to or greater than the number of all pixels of image information A such as to avoid overlapping between information A and information B. To display image information B, the CPU 111 only sets "Q0" to the address converter 115 without changing the content of the display memory 112, and the address converter 115 then adds "Q0" to the address value A1 from the selector 110 and outputs the added address to the image memory 108.

Image information B is read from the image memory 108 by the address value (A1+Q0) output from the address converter 115, in the same manner as reading of image information A, so that the image of image information B is displayed in the predetermined position on the screen of the display 109 instead of the image of image information A. It is possible to selectively display the image in the predetermined position on the display 109 by changeover between image information A and image information B only based on setting "0" or "Q0" as the added value set in the address converter 115.

It is therefore possible to alternately display, for example, two images represented by image information input to two different areas of the image memory 108 with respect to frames on the display 109 by alternately storing the image information and by alternately changing the value set in the address converter 115. If the image information stored in these two areas is, for example, animation image formation input with respect to frames, it is possible to change over the displayed image and to display the animation image at a high speed by changing the value of the address converter 115 with respect to frames of the animation information.

The address converter 115 used in accordance with this embodiment may be arranged to use a look-up table.

According to the above-described embodiments, characters, figures or the like can easily be combined with images to be displayed on the screen no matter what the kind of input image, an animation image or a still image and the numbers of pixels in the horizontal and vertical directions.

[THE THIRD EMBODIMENT]

Figure 18:
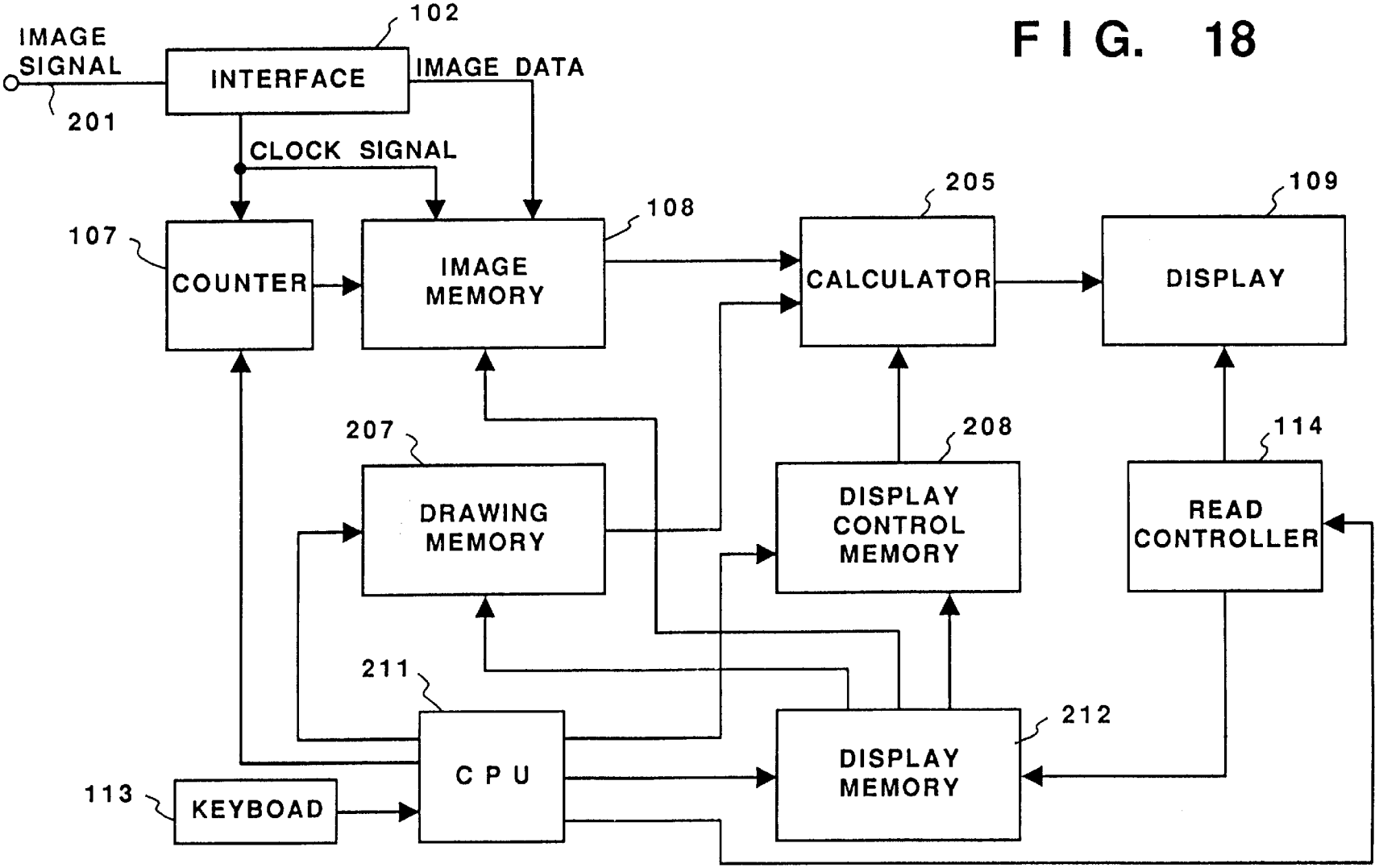
FIG. 18 is a block diagram schematically showing the construction of an image display controller in accordance with a third embodiment of the present invention.

FIG. 18 is a block diagram schematically showing the construction of an image display apparatus in accordance with the third embodiment of the present invention. Components of this embodiment identical or corresponding to those of the above-described embodiments are indicated by the same reference characters, and the description for them will not be repeated.

As shown in FIG. 18, a image signal 201 is input to an interface 102, and a clock signal is thereby extracted with respect to unit pixels and is output to an image memory 108 and a counter 107. The interface 102 also converts input image signal 201 into image information on pixels to be output to the image memory 108. A calculator 205 calculates display data from the image memory 108 and a drawing memory 207 in accordance with control information stored in a display control memory 208, and outputs the result of calculation to a display 109.

The drawing memory 207 is provided as a memory means for storing display information, and stores drawing information on characters, figures and the like displayed on the screen of the display 109. Such drawing information is written in the drawing memory 207 under the control of a CPU 211. Calculation information indicating the kind of calculation of data from the image memory 108 and the drawing memory 207 is stored in the display control memory 208 under the control of the CPU 211. Default values of information indicating the kind of calculation are also set in the display control memory 208 to display the drawing information with priority.

A display memory 212 is provided as an address memory means similar to the above-described display memory 112. The address values with which image information in the image memory 108 and drawing information in the drawing memory 207 to be output to the display 109 are written in the display memory 212 by the CPU 211 with respect to the pixels of the screen of the display 109. The read addresses of the image memory 108 and the drawing memory 207 are thereby output from the display memory 212, when image data is output to display images on the display 109. In this embodiment, the address values read from the display memory 212 are supplied to the image memory 108, the drawing memory 207 and the display control memory 208.

The CPU 211 controls writing of image signal 201 in the image memory 108 in accordance with an instruction input through a keyboard 113. When the coordinate positions at which pixels of image information written in the image memory 108 are displayed on the display 108 are obtained, the CPU 211 calculates the address values of pixel data in the image memory 108 and writes the calculated address values in the address of the display memory 212 corresponding to the coordinate positions. Further, the CPU 211 writes drawing information on characters, figures or the like to be displayed in the drawing memory 207.

Figure 20:
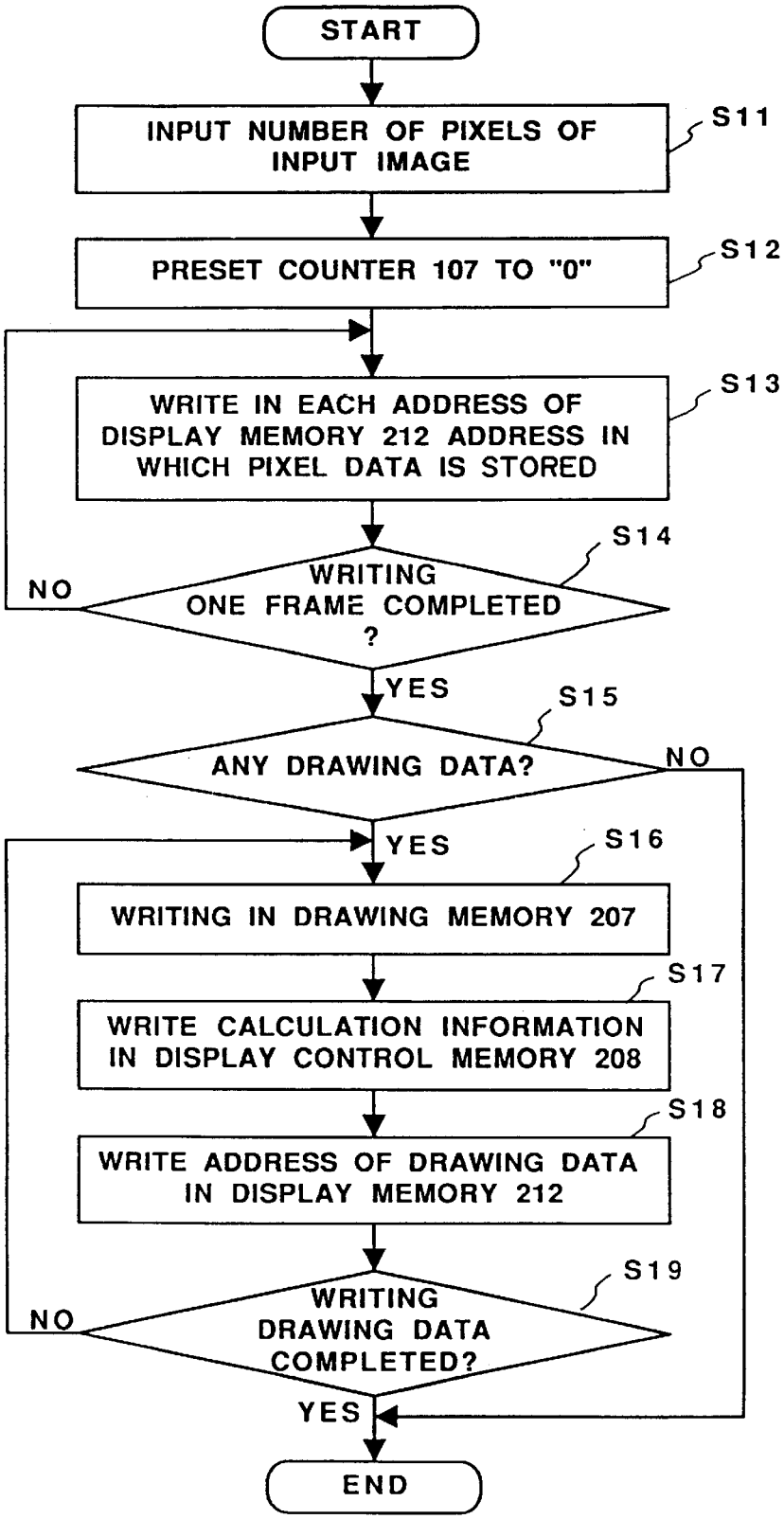
FIG. 20 is a flow chart of a control process conducted by the CPU of the third embodiment.

It is assumed here that the number of pixels in the horizontal direction of input image signal 201 is $X_s$, the number of pixels in the vertical direction is $Y_s$, the coordinate of an arbitrary pixel P of input image signal 201 is ($x_s$, $y_s$), the number of pixels in the horizontal direction of the display 109 is $X_d$, the number of pixels in the horizontal direction of the display 109 is $Y_d$, and the coordinate on the display 109 with which the pixel P is to be displayed is ($x_d$, $y_d$), as described above with reference to FIGS. 13 to 15. The operation of the this embodiment will now be described below with reference to FIG. 18 and the flowchart of FIG. 20.

In step S11, the number of pixels in the horizontal and vertical directions $X_s$ and $Y_s$ of the input image signal 201 and the displayed position on the display 109 are input through the keyboard 113. In step S12, the CPU 211 presets the value of the counter 107. Image data in image signal 201 from which a clock signal is separated by the interface 102 is input to the image memory 108 to be written in the address designated by the output from the counter 107 in synchronization with the clock signal. When data on one pixel is written in this manner, the counter 107 is incremented by the clock signal and the next pixel data is written in a new address of the image memory 108. Thus, pixel data is written in the image memory 108 from an address "0" to an address "$X_s \cdot Y_s - 1$".

In step S13, the CPU 211 writes the value of each address of the image memory 108 in which the image to be displayed is written in the address of the display memory 212 corresponding to the coordinate with which the image is to be displayed on the display 109. That is, the address of the image memory 108 in which the data on the above-mentioned pixel ($x_s$, $y_s$) is stored is expressed by $\{X_s \cdot (y_s-1)+x_s-1\}$, and the address on the display memory 212 corresponding to the coordinate ($x_d$, $y_d$) on the display 109 with which the pixel P is to be displayed is expressed by $\{X_d(y_d-1)+x_d-1\}$. This writing is performed in the same manner as that described above with reference to FIGS. 13 to 15. FIG. 19 shows a state in which the address of this image information is stored in the display memory 212. This step is the same as that of the above-described embodiment except that no flag is used. Thus, if the CPU 211 is instructed to display an image on the display 109, it stores the address values of image information on the image memory 108 in the address of the display memory corresponding to the display region.

When writing image data corresponding to one frame in this manner is completed, determination is made in step S15 as to whether there is a need to write, in the drawing memory 207, drawing information on characters or figures which is calculated with the image information to be displayed. If drawing information is to be written, the process proceeds from step S15 to S16 to write in the drawing memory 207 drawing information on characters or figures calculated with the image information in the image memory 108 and displayed. The address for this writing is the same as the address of the image memory 108 in which the pixel data of the image information which is the object of this calculation is stored. In step S17, the CPU 211 writes calculation information indicating the kind of required calculation in the display control memory 208. The address for this writing is also the same as the address of the image memory 108 in which th e pixel data of the image information to be calculated is stored. At this time, drawing information on figures or the like not calculated with the image information and not displayed is written in subsequent addresses at the address ($X_s \cdot Y_s$) of the drawing memory 207.

Then, in step S18, the value of the address of the drawing memory 207 in which drawing information is stored in this manner is written in the address of the display memory 212 corresponding to the displayed position on the display 109. This operation is repeated until the writing of drawing information is completed. This drawing data writing may be previously performed before the image information is written in the image memory 108.

Next, the operation of displaying images of image information written in the image memory 108 and drawing data in the drawing memory 207 will be described below. Data items written in the image memory 108, the drawing memory 207 and the display control memory 208 are read out in synchronization with the displaying operation of the display 109 by the read controller 114 and the display memory 212. That is, when various sync signals are output from the read controller 114 to the display 109, data items in the display memory 212 are successively read in synchronization with each sync signal.

A calculation of pixel data in image information stored in the image memory 108 and pixel data read from the drawing memory 207 in relation to this image information will be described below. The addresses of image information and drawing information relating to this pixel data (read addresses of the image memory 108 and the drawing memory 207) and the value of the address of the display control memory 208 in which the information indicating the kind of calculation is stored are output from the display memory 212. By these address outputs, image information on the corresponding pixel is read from the image memory 108 while drawing information on the corresponding pixel is read from the drawing memory 207. The outputs from the image memory 108 and the drawing memory 207 are respectively input to the calculator 205. The calculator 205 calculates pixel data from the image memory 108 and pixel data from the drawing memory 207 based on the information indicating the kind of calculation of the pixels output from the display control memory 208, and supplies the result of this calculation to the display 109 to display the resulting image.

With respect to a display region in which only drawing information stored in the drawing memory 207 is displayed, the address of the drawing memory 207 output from the display memory 212 is set to a value greater than the value of the image storage address of the image memory 108. Therefore no image information is correspondingly read from the image memory 108. The drawing information read from the drawing memory is directly output to the display 109 to be displayed by a calculation set by the default value and using drawing information with priority.

Next, a process of moving image information formed by combining drawing information and image information in accordance with this embodiment will be described below.

A case in which the displayed position of the above-mentioned pixel P is changed from a coordinate ($x_d$, $y_d$) to a coordinate ($x_d'$, $y_d'$) will be described. When this movement is designated, the CPU 211 transfers the value $\{X_s(y_s-1)+x_s-1\}$ stored in the address $\{X_d(y_d-1)+x_d-1\}$ of the display memory 212 to the address $\{X_d(y_d'-1)+x_d'-1\}$ of the display memory 212. The pixel P is thereby displayed at the coordinate ($x_d'$,$Y_d'$) on the screen of the display 109. Thus, the pixel P can be displayed with the display coordinate of the point P on the display 109 moved from ($x_d$, $y_d$) to ($x_d'$, $y_d'$), which movement can be achieved only by changing the value of the display memory 212 in accordance with the movement without changing the information on the pixel P in the image memory 108, the drawing memory 207 and the display control memory 208.

[THE FOURTH EMBODIMENT]

Figure 21:
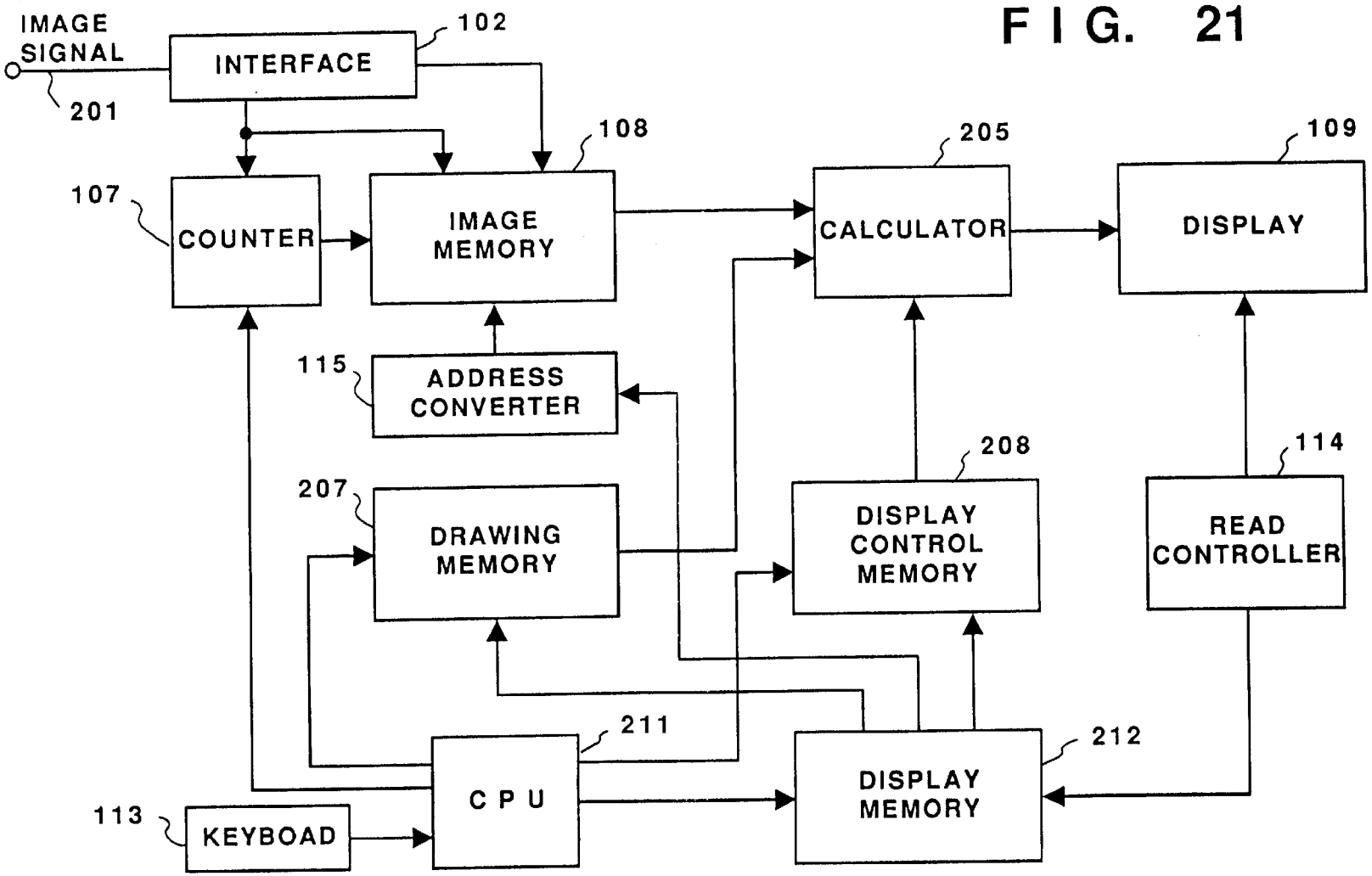
FIG. 21 is a block diagram schematically showing the construction of an image display apparatus in accordance with the fourth embodiment of the present invention.

FIG. 21 is a block diagram schematically showing the construction of an image display controller in accordance with the fourth embodiment of the present invention. Components of this embodiment identical or corresponding to those shown in FIG. 16 are indicated by the same reference characters. In this embodiment, an address converter 115 for processing address values output from the display memory 212 to the image memory 108 is added to the above embodiment, as in the case of the second embodiment.

An added value is supplied from the CPU 211 to the address converter 115. The value thereby set in the address converter 115 is added to the address output from the display memory 212, and the resulting added value is output as an address of the image memory 108.

Referring to FIG. 21, if image information A is written from address "0" of the image memory 108 as described above, the CPU 211 sets the added value supplied to the address converter 115 to "0", and writes, in the address of the display memory 212 corresponding to the coordinate of image information A on the screen of the display 109, the address value of each pixel of image information A in the image memory 108, as in the case of the above-described embodiment.

Next, image information B equal to image information A in both the numbers of pixels in the horizontal and vertical directions is written, for example, from the address "20" of the image memory 108. The value "20" is equal to or greater than the number of all pixels of image information A. To display image information B, the CPU 111 sets the added value of the address converter 115 to "20" without changing the content of the display memory 212. An address value obtained by adding "20" to the address value output from the display memory 212 is thereby output from the address converter 115. By this address value output from the address converter 115, image information B is read from the image memory 108 and is displayed in the predetermined position on the screen of the display 109 instead of image information A.

Thus, the display of image information A or B can be selected by setting "0" or "20" as the added value in the address converter 115. It is thereby possible to instantaneously change and display the image information in the image memory 108 with respect to the same drawing information. In this case as well, a movement of image information formed by combining image information in the image memory 108 and drawing information in the drawing memory 207 can be achieved in the same manner as the above-described embodiments.

According to this embodiment, as described above, various categories of information to be displayed are calculated by a designated calculation information and the calculated image can be displayed on the display screen while moving the displayed position at a high speed.

[THE FIFTH EMBODIMENT]

Figure 22:
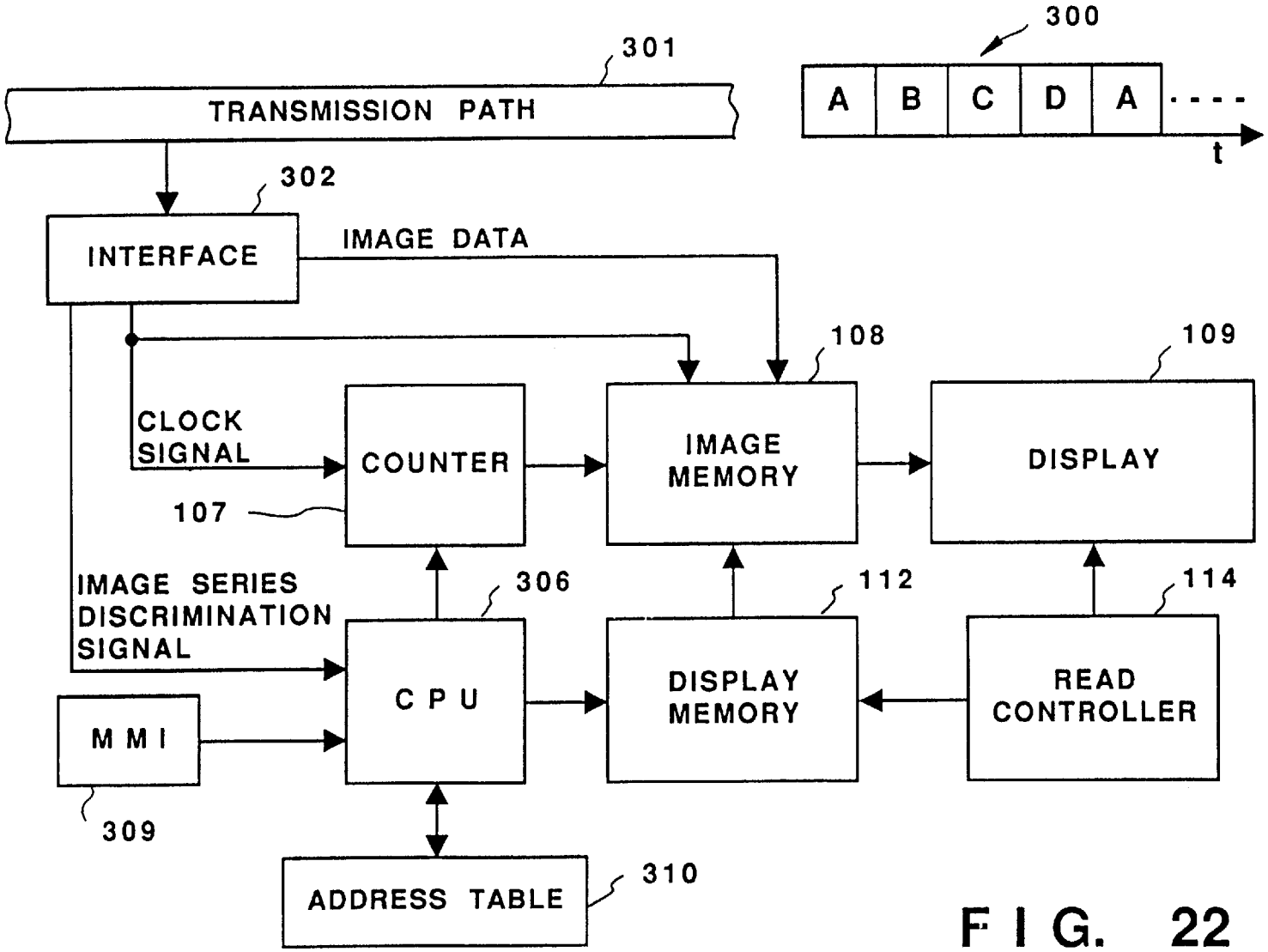
FIG. 22 is a block diagram schematically showing the construction of an image display apparatus in accordance with the fifth embodiment of the present invention.

FIG. 22 is a block diagram schematically showing the construction of an image display apparatus in accordance with the fifth embodiment of the present invention. Through a line 301 shown in FIG. 22, a plurality of image series A, B, C, and D are transmitted. An interface unit 302 interfacing with the transmission path 301 has a function of extracting an image series discrimination number added to the top of each series of image data items and transmitting the extracted numbers to a CPU 306 as well as a function of extracting a clock signal necessary for writing image data in an image memory 108. A counter 107 sets a preset value supplied from the CPU 306, counts the clock signal, and thereby outputs address values with which image data is written in the image memory 108. The image memory 108 has a dual-port construction such as to be capable of writing and reading independently. Also, the image memory 108 has a capacity large enough to store data on all pixels in one frame of each of the image series A, B, C, and D. The CPU 306 outputs the preset value to the counter 107 by referring to an address table 310 based on the image series discrimination number output from the interface 302. The CPU 306 calculates the values of addresses of the image memory 108 in which pixels of an image are written, and writes these address values in the addresses of a display memory 112 corresponding to coordinates with which the image written in the image memory 108 is to be displayed on a display 109. The display memory 112 is an address memory means, such as that described above, in which the value of the address of the image memory 108 in which each pixel of the image to be displayed is written by the CPU 306 with respect to each display pixel of the display 109. A read controller 114 sends various sync signals to the display 109 and reads data from the display memory 112 in synchronization with each sync signal. A man-machine interface (MMI) 309 designates image series to be displayed on the display 109, and inputs the positions at which the image series are displayed. An address table 310 stores preset values of counter 107 which serve as an offset address when each image series is written in the image memory 108.

Figure 23:
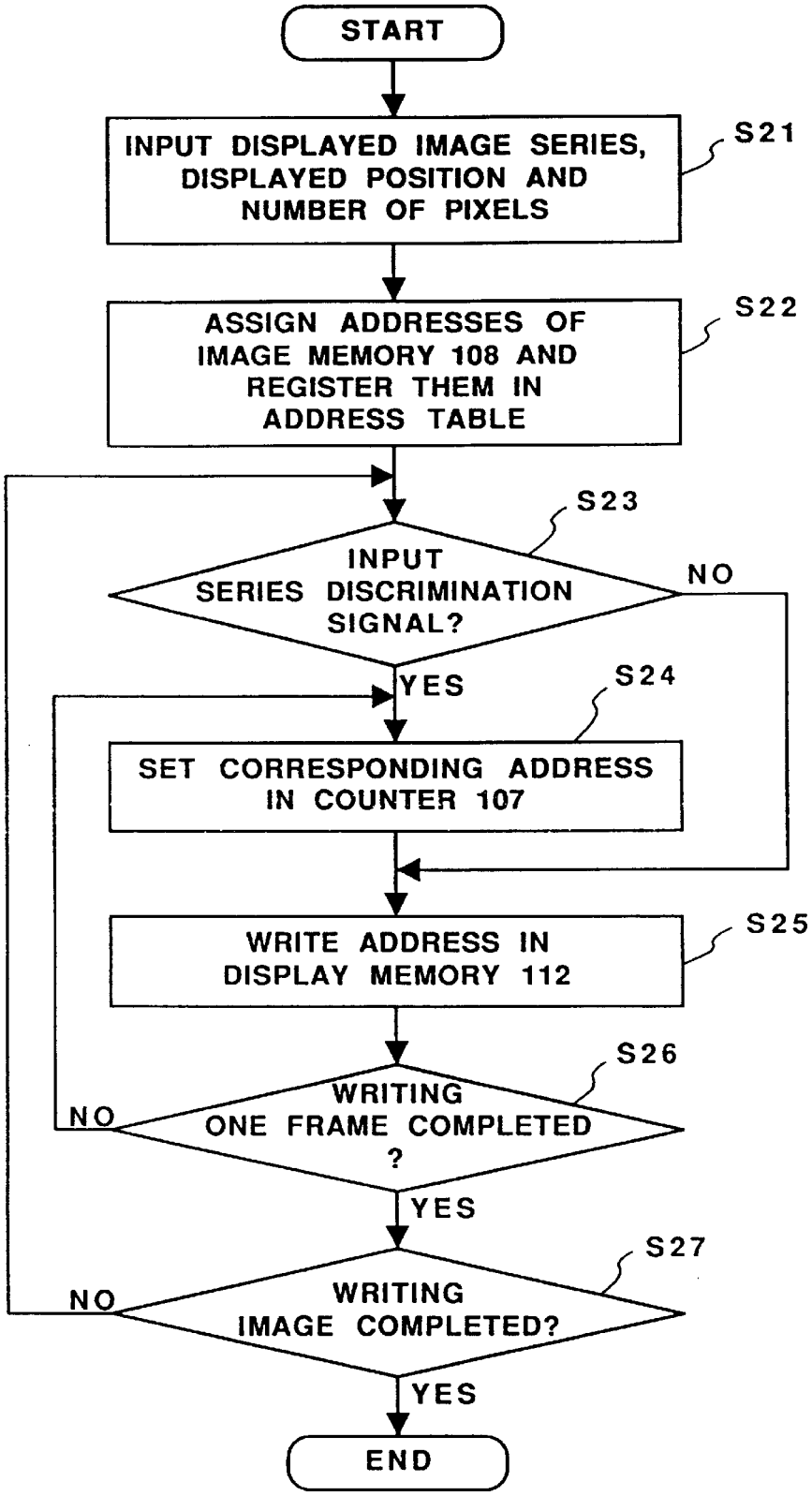
FIG. 23 is a flow chart of a control process conducted by the CPU of the fifth embodiment.
Figure 24A:
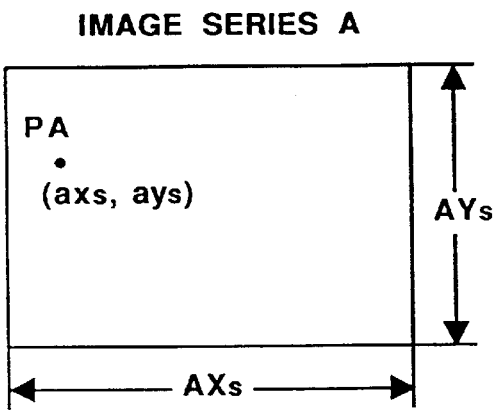
FIGS. 24A–24D are diagrams of the coordinates with which image series are displayed and the coordinates with which respective pixels are displayed in accordance with the fifth embodiment.
Figure 24B:
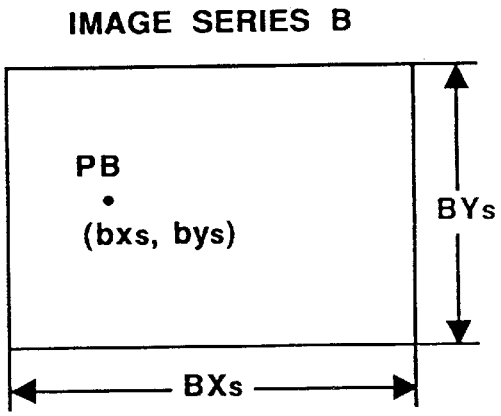
Figure 24C:
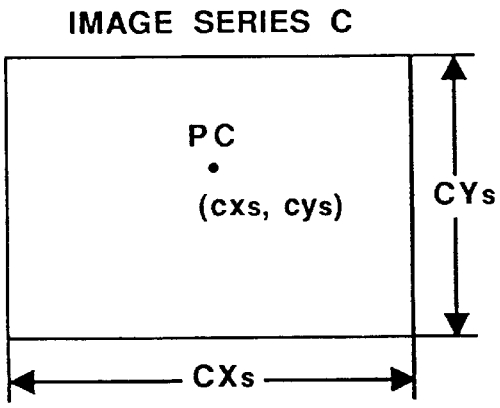
Figure 24D:
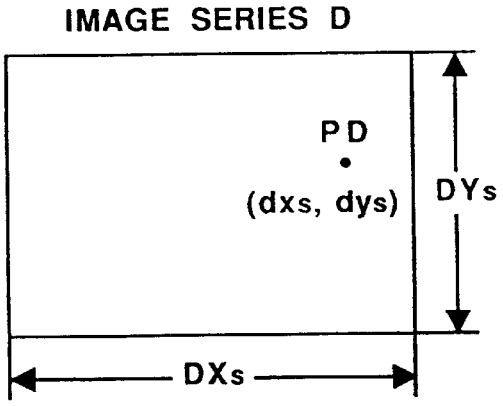

It is assumed here that the numbers of pixels in the horizontal direction of input image series A, B, C, and D are $AX_s$, $BX_s$, $CX_s$, and $DX_s$, respectively, the numbers of pixels in the vertical direction of these image series are $AY_s$, $BY_s$, $CY_s$, and $DY_s$, respectively, and the coordinates of arbitrary pixels PA, PB, PC, and PD of the image series are $(ax_s, ay_s)$, $(bx_s, by_s)$, $(cx_s, cy_s)$, $(dx_s, dy_s)$, respectively (See FIG. 24A–24D). It is also assumed that the number of pixels in the horizontal direction of the display 109 is $X_d$, the number of pixels in the vertical direction is $Y_d$, and the coordinate on the display 109 with which the pixels PA, PB, PC, and PD are respectively displayed are $(ax_d, ay_d)$, $(bx_d, by_d)$, $(cx_d, cy_d)$, $(dx_d, dy_d)$. The operation of the fifth embodiment will now be described below with reference to FIG. 22 and the flowchart of FIG. 23 showing the operation of the CPU 306.

In step S21, image series to be displayed on the display 109, the positions at which the image series are displayed, and the numbers of pixels in the vertical and horizontal directions of each image series are supplied from the MMI 309. In step S22, the CPU 306 assigns address values to the image memory 108 to store each image series, and registers offset address values in the address table 310 while correlating them with the image series discrimination numbers. For example, $A_{of}=0$ is assigned with respect to image series A, $B_{of}=AX_s \cdot AY_s$ with respect to image series B, $C_{of}=AX_s \cdot AY_s+BX_s \cdot BY_s$ with respect to image series C, and $D_{of}=AX_s \cdot AY_s+BX_s \cdot BY_s+CX_s \cdot CY_s$ with respect to image series D.

An image series discrimination signal is extracted from image signal 300 input from the transmission path 301 by the interface 302, and the image signal 300 is thereafter input to the CPU 306 (step S23). Receiving this image series discrimination signal, the CPU 306 searches the address table 310, and outputs offset address values corresponding to the image discrimination signal to the counter 107 to preset the counter 107 (step S24). By the interface 302, image data is converted into image data items with respect to pixels, and a clock signal synchronized with the image data item is formed to be supplied to the counter 107 and the image memory 108.

Image data item supplied to the image memory 108 is written by the clock signal in addresses of the image memory 108 designated by the output from the counter 107. Thereafter, the counter 107 is incremented by the clock signal. In this manner, one frame of each image series is written in the predetermined addresses of the image memory 108. Thereafter, image data item in the same series are overwritten in the predetermined addresses of the image memory 108. At this time, in step S25, the CPU 306 writes the value of the address of the image memory 108 in which each pixel of the image series is stored in the address of the display memory 112 corresponding to the coordinate on the display 109 with which the pixel indicated by the image data item on the image series is to be displayed. For example, as shown in FIGS. 24A–24D and 25, the address of the image memory 108 in which information on the above-mentioned pixel PA is stored is $\{A_{of}+AX_s(ay_s-1)+ax_s-1\}$, and the addresses for the pixels PB, PC, and PD are $\{B_{of}+BX_s(by_s-1)+bx_s-1\}$, $\{C_{of}+CX_s(cy_s-1)+cx_s-1\}$, and $\{D_{of}+DX_s(dy_s-1)+dx_s-1\}$, respectively.

Figure 26:
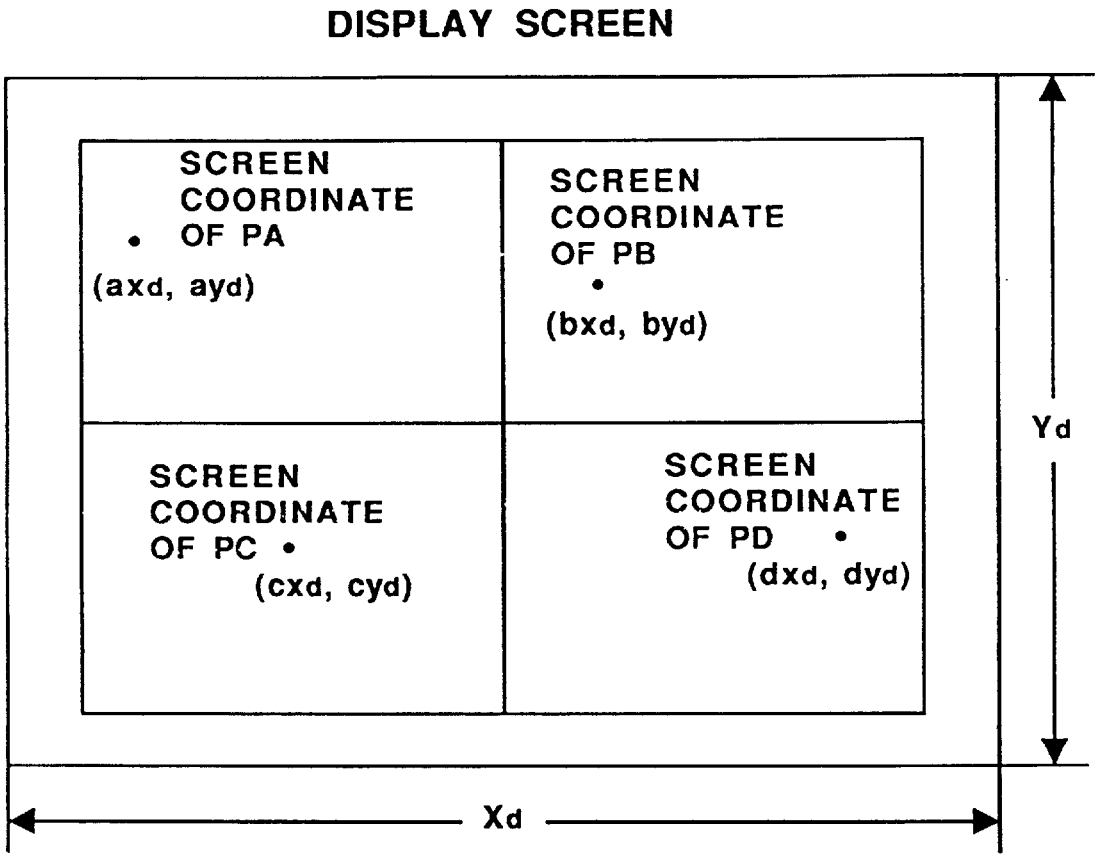
FIG. 26 is a diagram of the coordinates with which image series are displayed on the display screen and the coordinates with which respective pixels are displayed in accordance with the fifth embodiment.

The address value of the display memory 112 corresponding to the coordinate $(ax_d, ay_d)$ on the display 109 at which the pixel PA is to be displayed is $\{X_d \cdot (ay_d-1)+ax_d-1)\}$, and the corresponding address values for the pixels PB, PC, and PD are $\{X_d \cdot (by_d-1)+bx_d-1)\}$, $\{X_d \cdot (cy_d-1)+cx_d-1)\}$, and $\{X_d \cdot (dy_d-1)+dx_d-1)\}$, respectively, as shown in FIGS. 26 and 27.

That is, the CPU 306 writes the address $\{A_{of}+AX_s(ay_s-1)+ax_s-1\}$ of the image memory 108 for the pixel PA in the address $\{X_d \cdot (ay_d-1)+ax_d-1)\}$ of the display memory 112. Similarly, the CPU 306 writes the address $\{B_{of}+BX_s(by_s-1)+bx_s-1\}$ for the pixel PB in the address $\{X_d \cdot (by_d-1)+bx_d-1)\}$ of the display memory 112, the address $\{C_{of}+CX_s(cy_s-1)+cx_s-1\}$ for the pixel PC in the address $\{X_d \cdot (cy_d-1)+cx_d-1)\}$, and the address $\{D_{of}+DX_s(dy_s-1)+dx_s-1\}$ for the pixel PD in the address $\{X_d \cdot (dy_d-1)+dx_d-1)\}$. Thus, the CPU 306 performs writing in the above-described manner with respect to all the addresses of the display memory 112 corresponding to the designated display region to display the image data on the display 109.

If the displayed positions of the image series to be displayed overlap each other on the display 109, only the address of the image memory 108 in which each pixel of the image series to be displayed among the overlapping image series is written in the corresponding address of the display memory 112 in accordance with an instruction from the MMI 309.

Then, the various sync signals are output from the read controller 114 to the display 109 and the content of the display memory 112 is successively read out with respect to unit words in synchronization with each sync signal. Because the output from the display memory 112 is used to determine the read address of the image memory 108, only the address values for the pixels to be displayed may be stored in the display memory 112, thereby enabling data on the pixels actually displayed to be read out from the image memory 108 to display the pixels on the display 109.

It is thereby possible to constantly stably display the pixels of each image series corresponding to address values written in the display memory 112 even in an overlap region.

Data items in the image signal for each image series are successively overwritten in the addresses of the image memory 108 designated by the CPU 306 with respect to frames. However, there is no need to rewrite the content of the display memory 112 as long as the displayed position on the display 109 or the selection of the displayed image series in the overlap region is not changed, thus achieving a stable image display.

[THE SIXTH EMBODIMENT]

Figure 28:
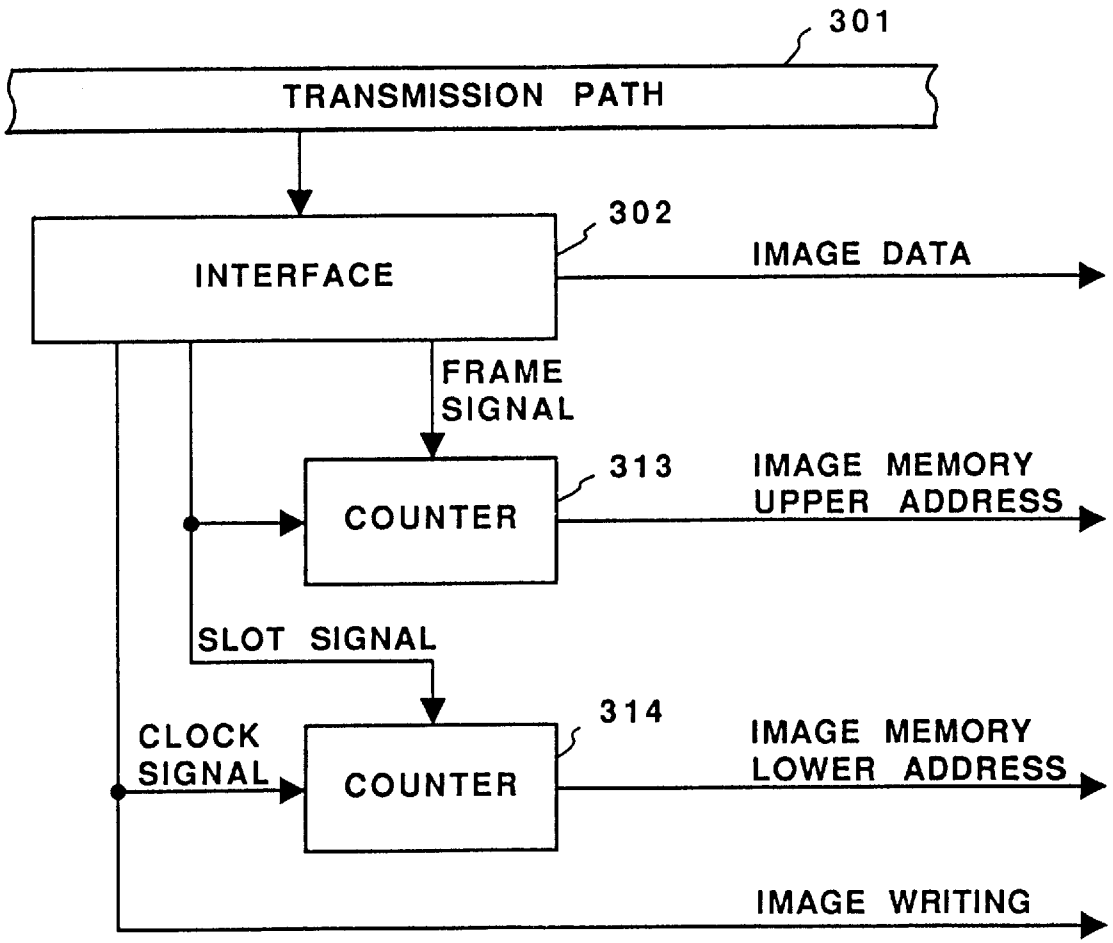
FIG. 28 is a block diagram of the construction of an image display apparatus in accordance with the sixth embodiment of the present invention.
Figure 29:
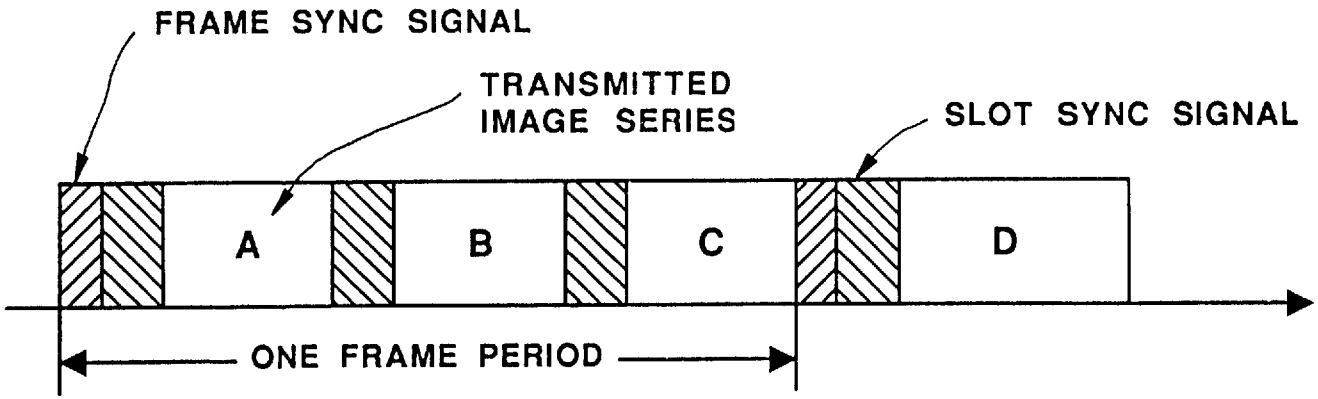
FIG. 29 is a diagram of an image transmission format in accordance with the sixth embodiment.

FIG. 28 is a block diagram showing the construction of address generation means in accordance with the sixth embodiment of the present invention. In this embodiment, the apparatus is used with a transmission path such that, as shown in FIG. 29, a plurality of image series A, B, and C are compressed into one frame period (1/30 second) and are set in the same number of slots to be transmitted. A frame sync signal for determining the frame period and a slot sync signal for sectioning slots are added to a signal on the transmission path 301.

Referring to FIG. 28, an interface 302 converts the transmitted signal input from the transmission path into image signals having pixel signals (image data items) corresponding to each pixel, and generates a clock signal in synchronization with the pixel signal. Further, the interface 302 extracts the frame sync signal and the slot sync signal to form a frame signal and a slot signal.

A counter 313 is connected upper addresses of the above-described image memory 108 and outputs different addresses with respect to the image series. A counter 314 is connected to lower addresses of the image memory 108, and the maximum countable number of the counter 314 is set to a value equal to or greater than the maximum number of pixels of the image series.

When the frame sync signal is input to the interface 302 from the transmission path 301, the interface 302 outputs the frame signal to the counter 313 to preset the counter 313 to a predetermined value. Then, when the slot sync signal is input, the interface 302 outputs the slot signal to the counters 313 and 314. The counter 313 counts the slot signal while the counter 314 is preset to a predetermined value by the slot signal.

When the image signal for image series A is thereafter input, the interface 302 outputs image data items corresponding to pixels to the image memory 108. These data items are written in synchronization with the clock signal in addresses of the image memory 108 addressed with address values output from the counters 313 and 314. When writing of the image data is thereby completed, the counter 314 is incremented by the clock signal. In this manner, one frame image in image series A is written in predetermined addresses of the image memory 108.

After the completion of writing of image series A, the interface 302 forms and outputs the slot signal from the slot sync signal to increment the counter 313. Upper addresses in which image series B is written are thereby set. At this time, the counter 314 is reset. Thereafter, image series B is written in the same manner as image series A, and image series C is then written. After the completion of writing of the image data of series A, B, and C in one frame period, the counter 313 is preset by the frame sync signal and writing in the next frame period is started.

The image data written in the image memory 108 in this manner is read out to display the image on the display 109 under the control of the read controller 114 in the same manner as the first embodiment.

In this embodiment, the CPU takes no part in generating write addresses for image data of each image series, so that the overall processing speed is increased.

In accordance with the fifth embodiment, as described above, a plurality of series of images input through a transmission path are discriminated and, when these image series are stored, write address regions for the written images are generated without overlapping with respect to the image series, so that the image of any number of image series in the plurality of image series transmitted on the transmission path can be displayed in an arbitrary position on the display screen.

The present invention may be applied to a system constituted of a plurality of image display apparatuses or to one image display apparatus. Needless to say, the present invention can also be applied to a system or apparatus capable of achieving the effect of the present invention by being provided with a suitable program.

Other many widely different embodiments of the present invention can be made without departing from the spirit and scope thereof, if it is to be understood that the invention is not limited to the specific embodiments thereof except as defined in the appended claims.

What is claimed is:

1. A method of controlling an image display process in which a plurality of groups of image data are input to display images of the image data on a display, said method comprising the steps of:

storing a first group of image data in a first memory;

storing address information of the first memory in which the first group of image data is stored, together with first discrimination information for specifying the first group, or information of a second group of image data together with second discrimination information for specifying the second group, into each address of a second memory having at least an address space corresponding to a display region on the display reading out the address information and the first discrimination information, or the information of the second group of image data and the second discrimination information from the second memory in synchronism with a display operation of the display;

reading out the image data from the first memory based on the address information read out from the second memory and displaying an image of the image data when the first group is specified by the first discrimination information, and displaying an image based on the information of the second group of image data from the second memory when the second group is specified by the second discrimination information.

2. A method according to claim 1, wherein the first group of image data includes still image data and/or figure data.

3. A method according to claim 1, wherein the second group of image data includes character data and/or figure data.

4. An image display control apparatus for inputting a plurality of groups of image data and displaying images of the image data on a display, said apparatus comprising:

first memory means for storing a first group of image data;

second memory means having at least a display address space corresponding to a display region on the display for storing address information of said first memory means in which the first group of image data is stored, together with first discrimination information for specifying the first group, or information of a second group of image data together with second discrimination information for specifying the second group, reading out means for reading out the address information and the first discrimination information, or the information of the second group of image data and the second discrimination information from said second memory means;

display means for reading out the first group of image data from said first memory means when the first group of image data is specified by the first discrimination information and displaying an image of the first group of image data, or for reading out the information of the second group of image data from said second memory means when the second group is specified by the second discrimination information and displaying an image of the second group of image data.

5. An image display control apparatus according to claim 4, further comprising addressing means for addressing said first memory means by adding a desired value to the address information read out from said second memory means.

6. An image display control apparatus for displaying an image on a display screen of a display unit, said apparatus comprising:

a plurality of memory means for respectively storing image data;

address memory means for storing addresses of each of said plurality of memory means each of which stores image data, with each of the addresses being stored in each address of said address memory means;

information memory means for storing calculation information indicating a kind of composition processing for combining a plurality of image data stored in said plurality of memory means;

address reading means for reading out the addresses from each address of said address memory means in synchronism with a display operation of the display unit;

image reading means for reading out image data from each of said plurality of memory means according to each of the addresses read out by said address means;

combining means for combining the image data read by said image reading means according to the calculation information stored in said information memory means; and display control means for displaying an image of image data combined by said combining means on the display screen.

7. An image display control apparatus according to claim 6, further comprising addressing means for addressing said plurality of memory means by adding a desired value to each of the addresses read out by said address memory means.

8. An apparatus according to claim 6, wherein said address memory means stores addresses of said information memory means which stores the information of calculation, and said address reading means reads addresses of said information memory means from said address memory means in synchronism with the display operation, and said combining means combines each image data according to the information of calculation read by said address reading means.

9. An image display control method for displaying an image on a display screen, said method comprising the steps of:

storing a plurality of image data in a plurality of first memories;

storing addresses of each of the plurality of first memories which store the plurality of image data, into a second memory, with each of the addresses being stored into each address of a second memory;

storing calculation information indicating a kind of composition processing for combining the plurality of image data stored in the plurality of first memories into a control memory;

reading each of the addresses from each address of the second memory in synchronism with a display operation of the display unit;

reading out each image data from the plurality of first memories according to each of the addresses read out from the second memory;

combining the plurality of image data read out in said reading out step, according to the calculation information stored in the control memory; and displaying an image combined in said combining step on the display screen.

10. An image display control method according to claim 9, further comprising the step of addressing said plurality of first memories by adding a desired value to each of the addresses from each address of the second memory.

11. A method according to claim 9, wherein in said storing address step, addresses of the control memory which stores the information of calculation are stored, and in said address reading step, the addresses of the control memory are read in synchronism with the display operation, and in said combining step, a plurality of image data are combined according to the information of calculation read in said address reading step.

12. An image display control apparatus for displaying a first group of image data and a second group of image data other than the first group of image data on a display screen of a display unit, said apparatus comprising:

a first memory for storing the first group of image data;

a second memory for storing each address of said first memory which stores the first group of image data, or the second group of image data, in each address of the second memory;

a read controller for accessing said second memory in synchronization with a displaying operation of said display unit to read contents of said second memory ; and a processor for accessing said first memory based on the address to output the first group of image data to the display unit, when the contents read from said second memory by said read controller include the address of the first memory, and for outputting the second group of image data to the display unit, when the contents read from said second memory by said read controller include the second group of image data.

13. An image display control apparatus for displaying on a display a first group of image data and a second group of image data other than the first group of image data by combining the first and second groups of image data, said apparatus comprising:

a first memory for storing the first group of image data in addresses with respect to pixels;

a second memory for storing the second group of image data in addresses with respect to pixels;

a third memory for storing a storage address value with which each data item of the first and second groups of image data representing each pixel is stored in the corresponding one of said first and second memories while correlating the storage address value with a display address with which the pixel is displayed;

a display control memory for storing information on composition of said first and second groups of image information while correlating the composition information with said display address, the content of said display control memory being read in synchronization with the displaying operation;

a read controller for accessing said third memory in synchronization with the displaying operation of said display to read the content of said third memory, when the contents of said first and second memories are displayed; and a calculation circuit for calculating and combining, according to the composition information read out by said read controller, the first and second groups of image data read out by accessing said first and second memories by the storage address value read from said third memory by said read controller.

14. An image display apparatus, comprising:

first memory means for storing first image data;

second memory means for storing address data of the first memory which stores the first image data, or second image data, in each memory address of said second memory means;

display means for displaying image data;

display control means for controlling said display means;

reading means for reading out the address data or the second image data from each memory address of said second memory means in synchronism with a control operation of said display control means; and supply means for supplying the first image data from the first memory based on the address data read by said reading means to said display control means when the address data is read from said second memory means by said reading means, and for supplying the second image data from said second memory to said display control means when the second image data is read from the second memory means by said reading means.

15. An image display apparatus according to claim 14, further comprising data input means for inputting the second image data to said second memory means.

* * * * *

UNITED STATES PATENT AND TRADEMARK OFFICE

CERTIFICATE OF CORRECTION

PATENT NO. : 5,818,434

DATED : October 6, 1998

INVENTOR(S) : MITSURU YAMAMOTO, ET AL.

Figure 8:
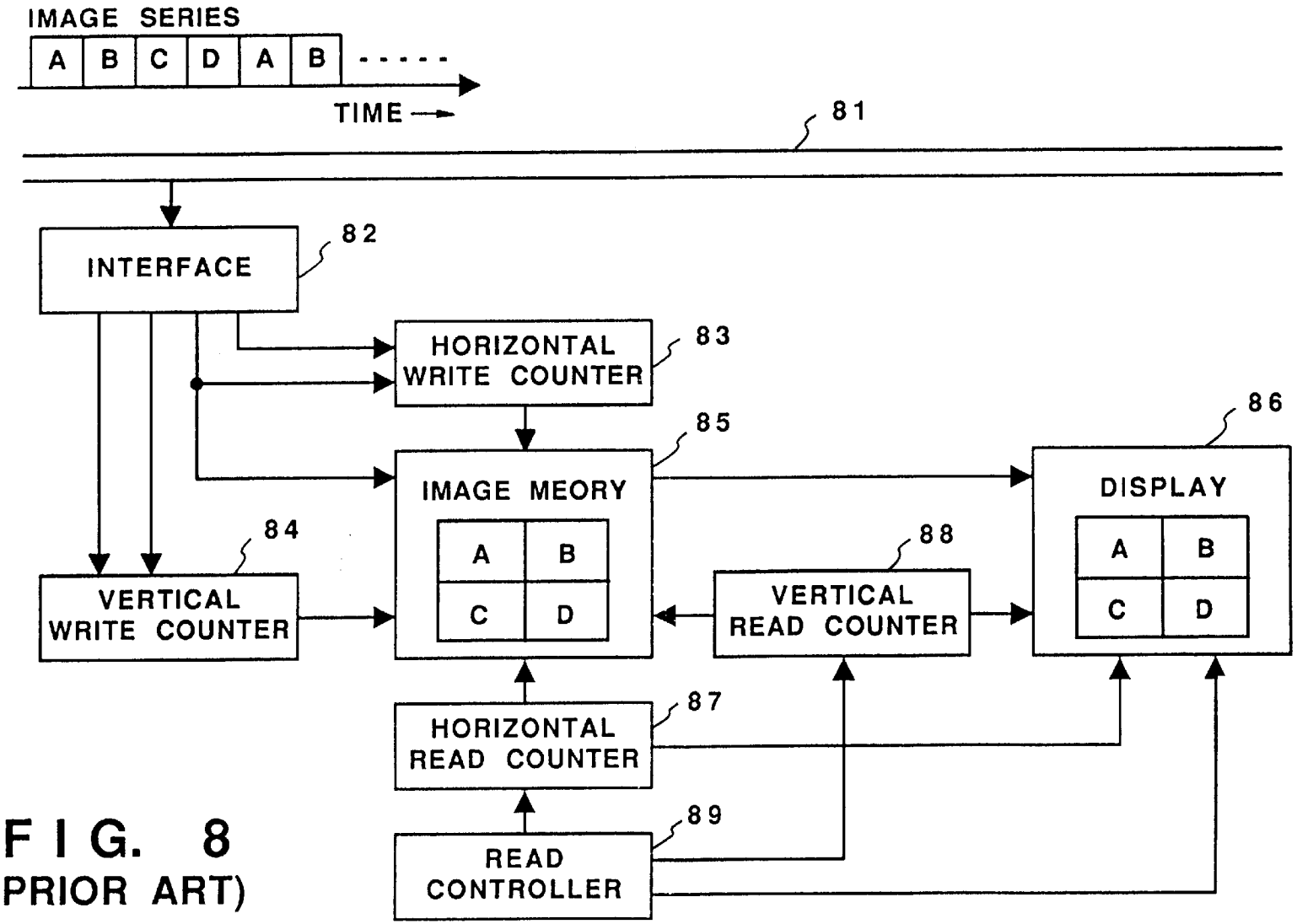
FIG. 8 (PRIOR ART)
FIG. 8 is a block diagram schematically showing another conventional image display controller.
Figure 9:
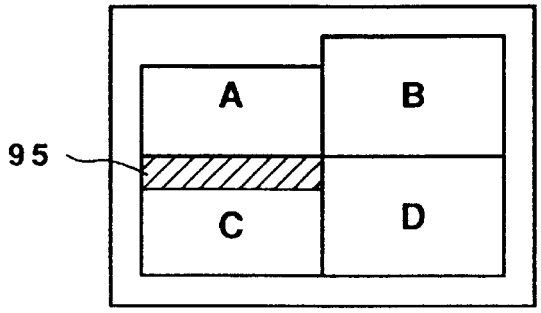
FIG. 9 (PRIOR ART)
FIGS. 9 and 11 are diagrams showing overlapped states of images relating to the problems of the conventional controller.
Figure 10:
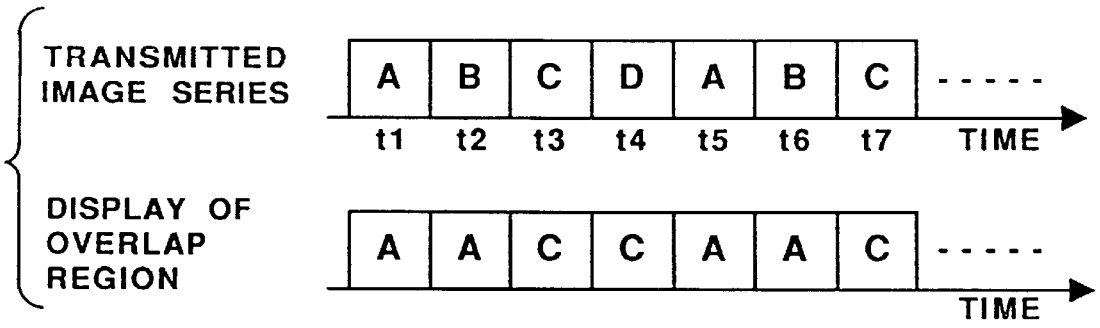
FIG. 10 (PRIOR ART)
FIGS. 10 and 12 are timing diagrams showing the relationship between a image overlapped state and series of transmitted images relating to the problems of the conventional controller.
Figure 11:
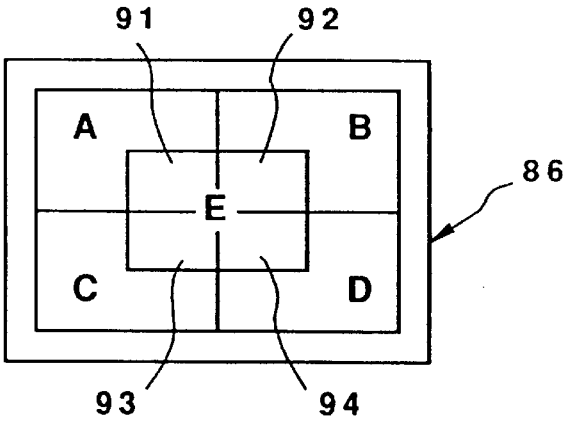
FIG. 11 (PRIOR ART)
Figure 12:
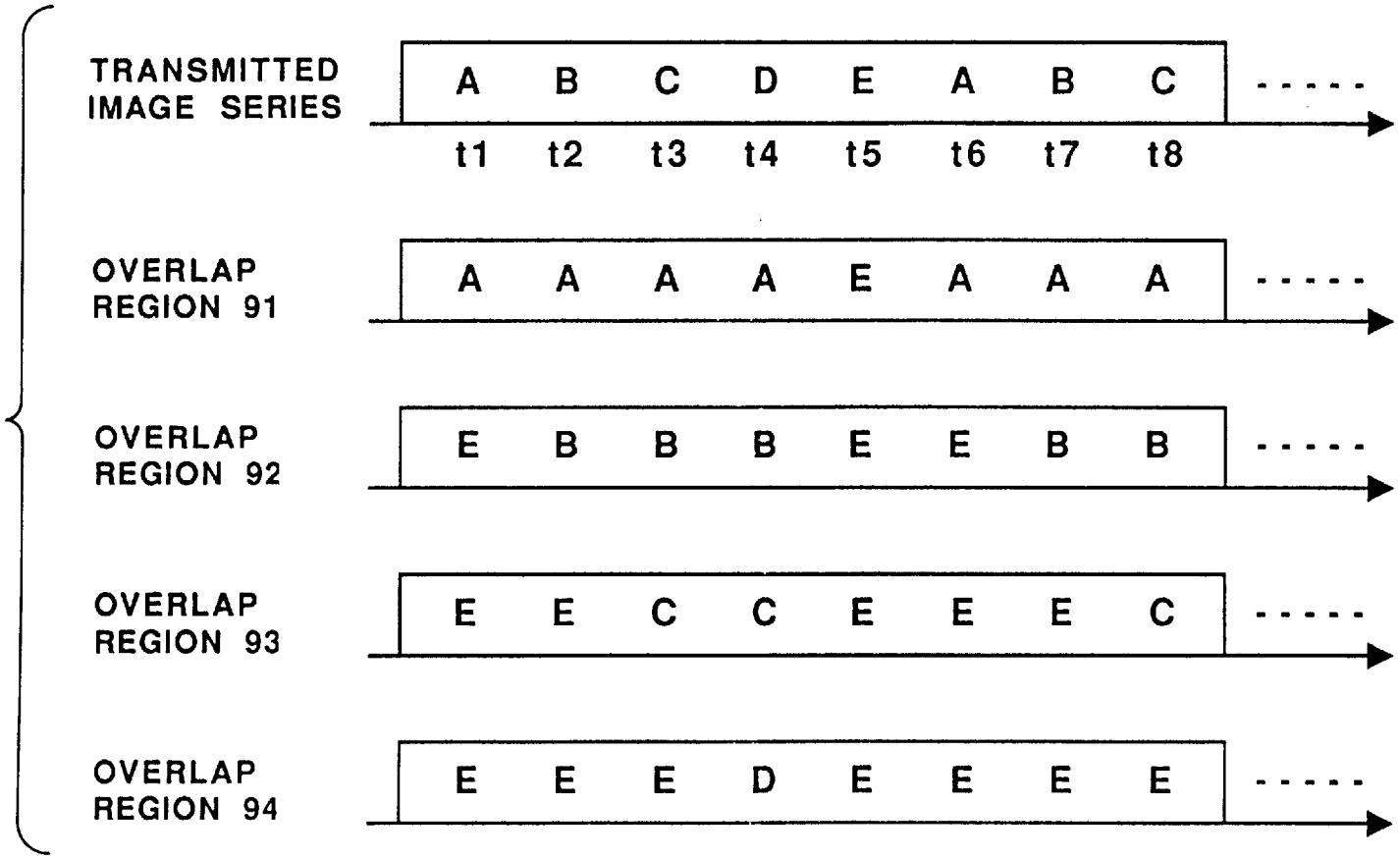
FIG. 12 (PRIOR ART)

It is certified that error appears in the above-identified patent and that said Letters Patent is hereby corrected as shown below:

IN THE DRAWINGS:

Sheet 7, Figure 8:

At Section 85, "MEORY" should read --MEMORY--.

COLUMN 12:

Line 42, "horizontal" should read --vertical--.

COLUMN 19:

Line 54, "means" should read --means,--.

Signed and Sealed this

Seventeenth Day of August, 1999

*Attest:*

*Attesting Officer*

Q. TODD DICKINSON

*Acting Commissioner of Patents and Trademarks*